US007281707B2

(12) United States Patent
Moriyama et al.

(10) Patent No.: US 7,281,707 B2
(45) Date of Patent: Oct. 16, 2007

(54) AFTERTREATMENT APPARATUS, AND CONTROLLING METHOD, PROGRAM AND STORAGE MEDIUM THEREFOR

(75) Inventors: Tsuyoshi Moriyama, Toride (JP); Norifumi Miyake, Kashiwa (JP); Takayuki Fujii, Tokyo (JP); Yasuo Fukatsu, Abiko (JP); Takako Hanada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 313 days.

(21) Appl. No.: 11/078,452

(22) Filed: Mar. 14, 2005

(65) Prior Publication Data

US 2005/0206064 A1 Sep. 22, 2005

(30) Foreign Application Priority Data

Mar. 19, 2004 (JP) ..... 2004-081175

(51) Int. Cl.
*B65H 37/04* (2006.01)

(52) U.S. Cl. ..... 270/58.04; 270/58.07; 270/58.08; 270/58.09; 271/288; 399/407; 399/408; 399/409; 399/410

(58) Field of Classification Search ..... 270/58.04, 270/58.07, 58.08, 58.09; 271/288; 399/407, 399/408, 409, 410
See application file for complete search history.

(56) References Cited

U.S. PATENT DOCUMENTS 4,878,656 A * 11/1989 Honjo et al. ..... 270/58.09
5,042,793 A 8/1991 Miyake ..... 271/293
5,455,667 A 10/1995 Hiroi et al. ..... 355/309
5,580,039 A 12/1996 Takehara et al. ..... 270/58.11
6,070,023 A * 5/2000 Kataoka ..... 399/45
6,131,898 A 10/2000 Hiroi et al. ..... 271/10.03
6,219,503 B1 4/2001 Miyake et al. ..... 399/85
6,330,422 B1 * 12/2001 Sato et al. ..... 399/382
6,337,970 B1 1/2002 Okamoto et al. ..... 399/407
6,353,726 B1 3/2002 Murata et al. ..... 399/407
6,357,737 B1 * 3/2002 Yoshida ..... 270/58.08
6,371,472 B1 4/2002 Miyake et al. ..... 270/58.14
6,386,080 B1 5/2002 Okamoto et al. ..... 83/73
6,505,017 B2 1/2003 Fujii et al. ..... 399/82
6,517,065 B2 2/2003 Miyake et al. ..... 270/58.09
6,603,951 B2 8/2003 Sato et al. ..... 399/382
6,826,374 B2 11/2004 Kato et al. ..... 399/16
6,871,042 B2 3/2005 Nemura et al. ..... 399/389
6,904,261 B2 6/2005 Fujii et al. ..... 399/382
2002/0074708 A1 * 6/2002 Nagata et al. ..... 270/58.08
2002/0190456 A1 12/2002 Miyake et al. ..... 270/58.08
2003/0102618 A1 * 6/2003 Sesek ..... 270/58.08
2003/0118384 A1 6/2003 Moriyama ..... 399/382
2003/0235448 A1 * 12/2003 Nemura et al. ..... 399/389

(Continued)

FOREIGN PATENT DOCUMENTS

JP 60-180894 9/1985

(Continued)

*Primary Examiner*—Gene O Crawford
*Assistant Examiner*—Leslie A Nicholson, III
(74) *Attorney, Agent, or Firm*—Fitzpatrick, Cella, Harper & Scinto

(57) ABSTRACT

Sheet thickness data obtained from the output of a sheet thickness detecting sensor are calculated to thereby calculate a sheet bundle thickness. When the sheet bundle thickness reaches a predetermined value, other aftertreatment differing from a set aftertreatment is executed.

1 Claim, 18 Drawing Sheets

U.S. PATENT DOCUMENTS

| | | | | |
|---|---|---|---|---|
| 2004/0022564 | A1 | 2/2004 | Fujii et al. | 399/382 |
| 2004/0047008 | A1 | 3/2004 | Fujii | 358/498 |
| 2005/0063023 | A1 | 3/2005 | Komatsu et al. | 358/488 |
| 2005/0152725 | A1* | 7/2005 | Mochizuki | 399/410 |

FOREIGN PATENT DOCUMENTS

| | | | |
|---|---|---|---|
| JP | 60-191932 | | 9/1985 |
| JP | 60-204564 | | 10/1985 |
| JP | 62186279 | A * | 8/1987 |
| JP | 2-38262 | | 2/1990 |
| JP | 10-151734 | | 6/1998 |
| JP | 2000-184154 | | 6/2000 |
| JP | 2003-1910 | | 1/2003 |
| JP | 2004-43041 | | 2/2004 |

* cited by examiner

AFTERTREATMENT APPARATUS, AND CONTROLLING METHOD, PROGRAM AND STORAGE MEDIUM THEREFOR

BACKGROUND OF THE INVENTION

1. Field of the Invention

The invention relates to an aftertreatment apparatus for effecting an aftertreatment on paper sheets, and a controlling method, a program and a storage medium therefor.

2. Description of Related Art

Generally, an image forming apparatus such as a copying machine has connected thereto a finisher or the like for effecting an aftertreatment such as a staple treatment or bookbinding on sheets having images formed thereon. For example, in the staple treatment, a stapler is driven and a sorted sheet bundle is stapled.

Also, in recent years, a finisher provided with an inserted sheet feeder for supplying an inserted into a bundle of sheets having images formed thereon has made its appearance (see Japanese Patent Application Laid-Open Nos. S60-180894, S60-191932 and S60-204564). In such a finisher, an inserted sheet is supplied from the inserted sheet feeder into the finisher at predetermined timing, and is conveyed to an intermediate tray in the finisher. Then, the inserted sheet is stacked on sheets from the image forming apparatus stacked on the intermediate tray. Here, sheets including the inserted sheet are stacked on the intermediate tray so as to be in the order of pages and the predetermined timing at which the inserted sheet is supplied is such timing that the inserted sheet assumes a corresponding page position in the sheet bundle.

Also, in order to cope with a case where originals more than a predetermined maximum number of bound sheets are read and a staple treatment is effected on a bundle of the sheets having images formed thereon, there is an image forming apparatus provided with a divisional staple mode for dividing the sheets by each predetermined number of sheets and binding them.

As an inserted sheet such as a cover sheet or a slip-sheet supplied from the inserted sheet feeder, use is often made of a sheet thicker than sheets on which images are formed in the image forming apparatus. Also, in a case where there are a plurality of inserted sheet feeders, it is supposed that sheets having various sheet thicknesses are fed from the respective inserted sheet feeders. Consequently, in a case where a maximum number of sheets capable of being stapled are predetermined and sheets of different thicknesses are mixedly present in a sheet bundle, even if the number of sheets is within the maximum number of sheets capable of being stapled, the thickness of the sheet bundle sometimes exceeds a thickness capable of being stapled. In such case, staple needles may be buckled and the dignity of binding may become bad, and the needle jam of the stapler may occur and as a result, a faulty aftertreatment may occur.

Also, in the case of a pre-divisional staple mode, if sheets inserted sheets supplied from the inserted sheet feeder are likewise mixedly present in a sheet bundle, a sheet bundle having a predetermined number of sheets sometimes exceeds a thickness capable of being stapled, and the buckle or jam of staple needles may occur.

To avoid such inconvenience, it is desired, for example, to measure the thickness of the sheet bundle at real time, and effect, for example, divisional staple treatment or the like with an appropriate thickness of the sheet bundle.

Also, when a punch treatment is to be effected in the finisher, even if in the case of a bundle sheet in which sheets of different thicknesses are mixedly present, the number of sheets is within a maximum number of sheets capable of being punched, the thickness of the sheet bundle sometimes exceeds a thickness capable of being punched as in the case of the already described stapler treatment.

In Japanese Patent Application Laid-Open No. 2003-1910, it is disclosed to judge from the thickness of a bundle of sheets calculated by calculating means whether the staple treatment is possible in an image forming apparatus having an operating panel for setting the condition of the sheets, and calculating means for calculating the thickness of the bundle of sheets to be staple-treatment from the condition set by the operating panel. Japanese Patent Application Laid-Open No. 2003-1910, however, merely discloses a construction in which sheets on which images are to be formed are set by the operating panel. Consequently, it cannot cope with a sheet inserted into sheets having images formed thereon. Further, in the apparatus of Japanese Patent Application Laid-Open No. 2003-1910, the thicknesses of the sheets are selected by the operating panel. Consequently, the apparatus of Japanese Patent Application Laid-Open No. 2003-1910 is established as an apparatus on the premise that the thickness of the sheets are all found prior to the setting by the operating panel. Accordingly, the apparatus of Japanese Patent Application Laid-Open No. 2003-1910 cannot cope with a case where it is difficult for the thicknesses of sheets to be found in advance, that is, a case where various types of sheets are used.

In Japanese Patent Application Laid-Open No. H2-38262, there is described a sheet aftertreatment controlling apparatus which is provided a gripper for nipping and conveying a sheet bundle, and means provided on the gripper for detecting the thickness of the sheet bundle nipped by the gripper, and which does not perform a stapling operation when it is judged that the thickness of the sheet bundle has exceeded the limit thickness bundle has exceeded the limit thickness capable of being stapled. In the construction described in Japanese Patent Application Laid-Open No. H2-38262, much time is required for nipping the sheets of a bundle shape by the gripper, and this leads to a problem in respect of an improvement in productivity.

In Japanese Patent Application Laid-Open No. 2000-184154, it is disclosed to detect the thicknesses of respective recording mediums and accumulate these thicknesses to thereby find the width of the spine of a sheet bundle when bookbound. In Japanese Patent Application Laid-Open No. 2000-184154, however, to find the width of the spine is in order to determine the image positions of the cover and spine, and no description is made of a problem attributable to the above-noted maximum number of sheets capable of being stapled or the maximum number of sheets capable of being punched. Saying in addition, the construction of Japanese Patent Application Laid-Open No. 2000-184154 detects the thicknesses of the recording mediums (sheets) on which images are recorded, and does not cope with the thickness of a sheet inserted into sheets having images formed thereon.

SUMMARY OF THE INVENTION

It is the object of the present invention to provide an aftertreatment apparatus, a controlling method, a program and a storage medium which can obviate the occurrence of a faulty aftertreatment attributable to the thickness of a sheet bundle when sheets of different thicknesses are mixedly present in the sheet bundle.

In order to achieve the above object, the aftertreatment apparatus of the present invention has:

a common conveying path for conveying sheets having images formed thereon by an image forming unit and a sheet to be inserted in the order in which they have been carried in;

an aftertreatment unit for forming a sheet bundle of the sheets conveyed through the common conveying path, and effecting set aftertreatment on the sheet-bundle;

a sheet thickness detecting sensor for detecting the thickness of each sheet conveyed on the common conveying path;

a controller for accumulating the thicknesses of the sheets detected by the sheet thickness detecting sensor to thereby calculate the thickness of the sheet bundle, and controlling the aftertreatment unit so as to change the set aftertreatment to other aftertreatment when the calculated thickness of the sheet bundle reaches a predetermined value.

DETAILED DESCRIPTION OF THE PREFERRED EMBODIMENTS

Some embodiments of the present invention will hereinafter be described with reference to the drawings.

First Embodiment

Figure 1:
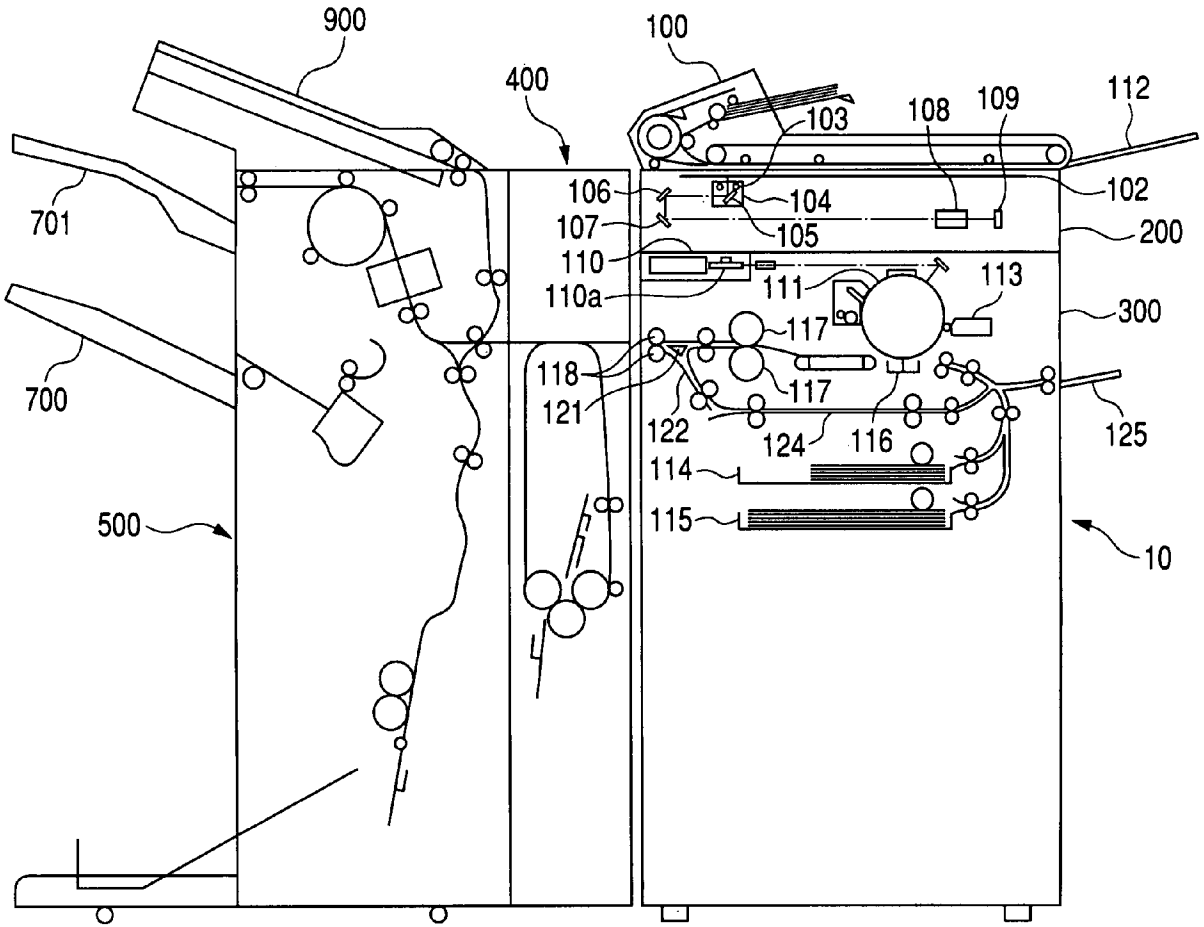
FIG. 1 is a longitudinal cross-sectional view showing the construction of the essential portions of an image forming apparatus to which is connected a finisher as an aftertreatment apparatus according to a first embodiment of the present invention.

FIG. 1 is a longitudinal cross-sectional view showing the construction of the essential portions of an image forming apparatus to which is connected a finisher as an aftertreatment apparatus according to a first embodiment of the present invention.

The image forming apparatus as shown in FIG. 1, is comprised of an image forming apparatus main body a folding apparatus 400 and a finisher 500, and the image forming apparatus main body 10 is provided with an image reader 200 for reading the image of an original, and a printer 300.

An original feeding device 100 is carried on the image reader 200. The original feeding device 100 leftwardly feeds originals upwardly set on an original tray one by one in succession from the first page, conveys the original from the left to the right on platen glass (original plate) 102 through a curved path via a flow reading position, and thereafter discharges the original toward a external sheet discharging tray 112. This original, when it passes the flow reading position on the platen glass 102 from the left toward the right, is read by a scanner unit 104 held at a position corresponding to the flow reading position. This reading method is a method generally called flow reading. Specifically, when the original passes the flow reading position, the surface of the original to be read is irradiated with the light of the lamp 103 of the scanner unit 104, and reflected light from the original is directed to a lens 108 through the intermediary of mirrors 105, 106 and 107. The light passed through this lens 108 is imaged on the image pickup surface of an image sensor 109.

By the original being thus conveyed so as to pass the flow reading position from the left to the right, there is effected original reading scanning in which a direction orthogonal to the conveying direction of the original is a main scanning direction and the conveying direction is a sub-scanning direction. That is, the original is conveyed in the sub-scanning direction while the image of the, original is read in each line by the image sensor 109 in the main scanning direction when the original passes the flow reading position, whereby the reading of the whole image of the original is effected, and the optically read image is converted into image data by the image sensor 109 and is outputted. The image data outputted from the image sensor 109 is subjected to predetermined processing in an image signal controlling portion 202 which will be described later, and thereafter is inputted as a video signal to the exposure controlling portion 110 of the printer 300.

The original is conveyed onto the platen glass 102 by the original feeding device 100 and is stopped at a predetermined position, and in this state, the scanner unit 104 is caused to scan from the left to the right, whereby it is also possible to read the original. This reading method is a method called original fixed reading.

When the original is to be read without the use of the original feeding device 100, the original feeding device 100 is first raised by a user and the original is placed on the platen glass 102, and the scanner unit 104 is caused to scan from the left to the right to thereby effect the reading of the original. That is, when the original is to be read without the use of the original feeding device 100, the original fixed reading is effected.

The exposure controlling portion 110 of the printer 300 modulates and outputs a laser beam on the basis of the inputted video signal, and the laser beam is applied onto a photosensitive drum 111 while being scanned by a polygon mirror 110*a*. An electrostatic latent image conforming to the scanned laser beam is formed on the photosensitive drum 111. Here, the exposure controlling portion 110, as will be described later, outputs the laser beam during the original fixed reading so that a correct image (an image which is not a mirror image) may be formed.

The electrostatic latent image on this photosensitive drum 111 is developed into a visible image as a developer image by a developer supplied from a developing device 113. Also, at timing synchronized with the start of the application of the laser beam, paper which is a sheet is fed from a cassette 114 or 115, a manually feeding portion 125 or a two-side conveying path 124, and this paper is conveyed to between the photosensitive drum 111 and a transferring portion 116. The developer image formed on the photosensitive drum 111 is transferred onto the fed paper by the transferring portion 116.

The paper onto which the developer image has been transferred is conveyed to a fixing portion 117, which heats and pressurizes the paper to thereby fix the developer image on the paper. The paper having passed through the fixing portion 117 is discharged from the printer 300 to the outside (a folding device 400) via a flapper 121 and discharge rollers 118. The photosensitive drum 111, developing device 113, the transferring portion 116, and a fixing portion 117 constitute image forming unit for forming image on a paper.

Here, when the paper is to be discharged in a state in which the image-formed side thereof faces downwardly (face-down), the paper having passed through the fixing portion 117 is once directed into a reversing path 122 by the switching operation of the flapper 121, and after the trailing edge of the paper has passed the flapper 121, the paper is switched back and is discharged from the printer 300 by the discharge rollers 118. This sheet discharge aspect will hereinafter be called reversal discharge. This reversal discharge is effected such when image forming is effected in the order of the first page as when an image read by the use of the original feeding device 100 is formed or when an image outputted from a computer is formed, and the order of the paper after discharged becomes a correct page order.

Also, when hard paper such as OHP paper is fed from the manually feeding portion 125 and an image is to be formed on this paper, the paper is not directed to the reversing path 122, but is discharged in a state in which the image-formed side thereof facing upwardly (face-up) by the discharge rollers 118.

Further, in a case where two-side recording in which image forming is effected on the two sides of the paper is set, the paper is directed to the reversing path 122 by the switching operation of the flapper 121, and there after is conveyed to a two-side conveying path 124, and the control of again feeding the paper directed to the two-side conveying path to between the photosensitive drum 111 and the transferring portion 116 at the above-described timing.

The paper discharged from the printer 300 is sent to the folding device 400. This folding device 400 carries out the process of folding the paper into a Z-shape. When for example, the paper is paper of A3 size or B4 size and the folding process is designated, the folding process is carried out by the folding device 400, and in the other cases, the paper discharged from the printer 300 passes through the folding device 400 and is sent to the finisher 500. This finisher 500 is provided with an inserter 900 for feeding special paper such as a cover or a slip sheet into sheets having images formed thereon treatments such as a bookbinding treatment, a stapling treatment and punching are effected in the finisher 500.

Figure 2:
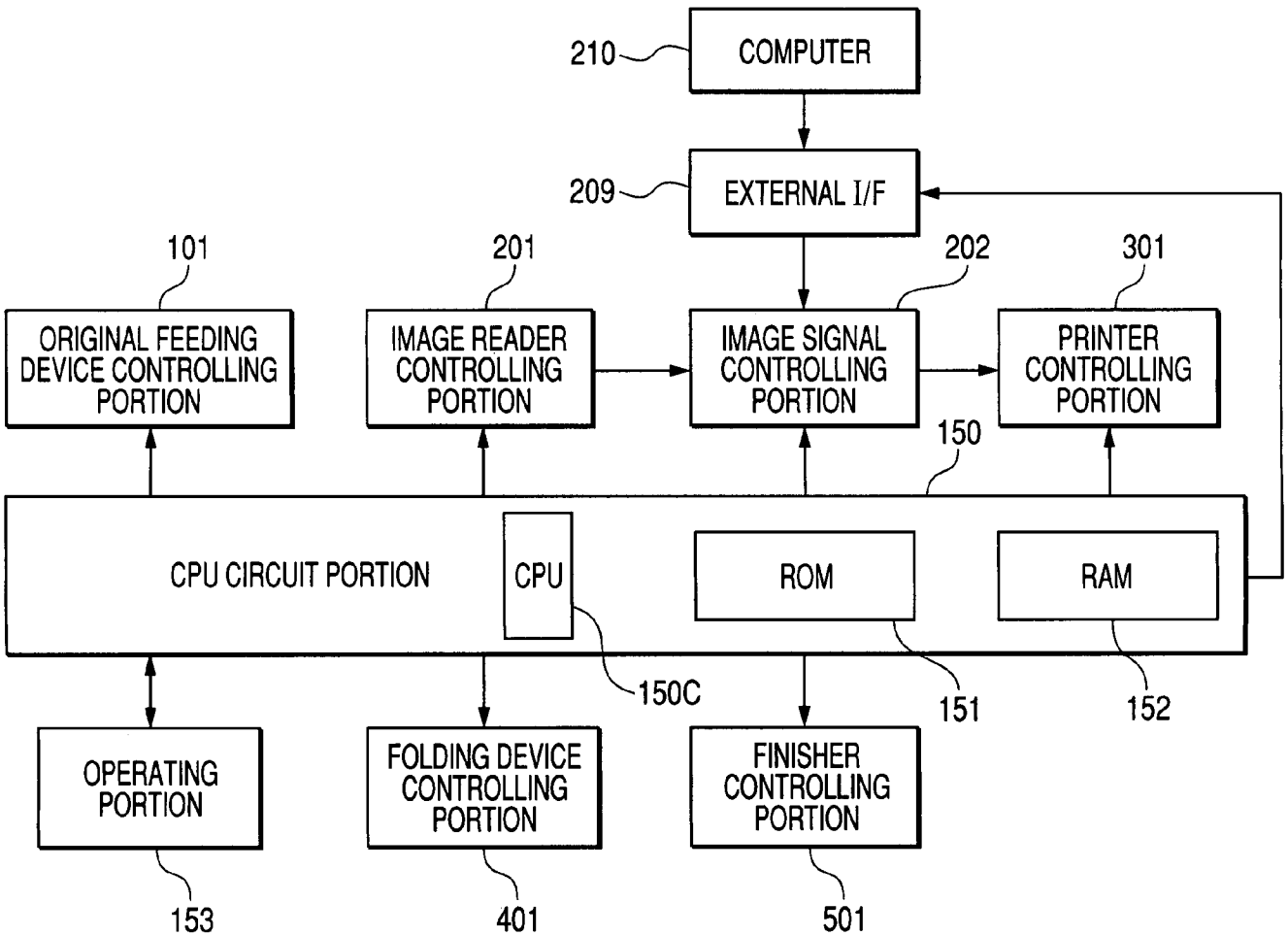
FIG. 2 is a block diagram showing the construction of a controller which governs the controller of the entire image forming apparatus of FIG. 1.

The construction of a controller which governs the control of the entire image forming apparatus will now be described with reference to FIG. 2. FIG. 2 is a block diagram showing the construction of the controller which governs the control of the entire image forming apparatus of FIG. 1.

A main body controller provided in the image forming apparatus main body 10 has a CPU circuit portion 150, as shown in FIG. 2, and the CPU circuit portion 150 contains a CPU 150C, a ROM 151 and a RAM 152 therein, and collectively controls respective blocks 101, 153, 201, 202, 209, 301, 401 and 501 by a control program stored in the ROM 151. The RAM 152 temporarily holds control data therein, and is used as a working area for a calculating process resulting from control.

An original feeding device controlling portion 101 drive-controls the original feeding device 100 on the basis of instructions from the CPU circuit portion 150. An image reader controlling portion 201 effects drive control for the above-described scanner unit 104 and image sensor 109, and forwards an analog image signal outputted from the image sensor 109 to an image signal controlling portion 202.

The image signal controlling portion 202 converts the analog image signal from the image sensor 109 into a digital signal and thereafter carries out each process, and converts this digital signal into a video signal and outputs it to a printer controlling portion 301. It also carries out various processes on a digital image signal inputted from a computer 210 through an external I/F 209, converts this digital image signal into a video signal and outputs it to the printer controlling portion 301. The processing operation of this image signal controlling portion 202 is controlled by the CPU circuit portion 150. The printer controlling portion 301 drives the above-described exposure controlling portion 110 on the basis of the inputted video signal.

An operating portion 153 has a plurality of keys for setting various functions regarding image forming, a displaying portion for displaying information indicative of a set state, etc., and outputs a key signal corresponding to the operation of each key to the CPU circuit portion 150, and also displays corresponding information on the displaying portion on the basis of a signal from the CPU circuit portion 150.

A folding device controlling portion 401 is carried on the folding device 400, and effects the exchange of information with the CPU circuit portion 150 to thereby effect the drive control of the entire folding device.

A finisher controlling portion 501 is carried on the finisher 500, and effects the exchange of information with the CPU circuit portion 150 to thereby effect the drive control of the entire finisher. The contents of this control will be described later.

Figure 3:
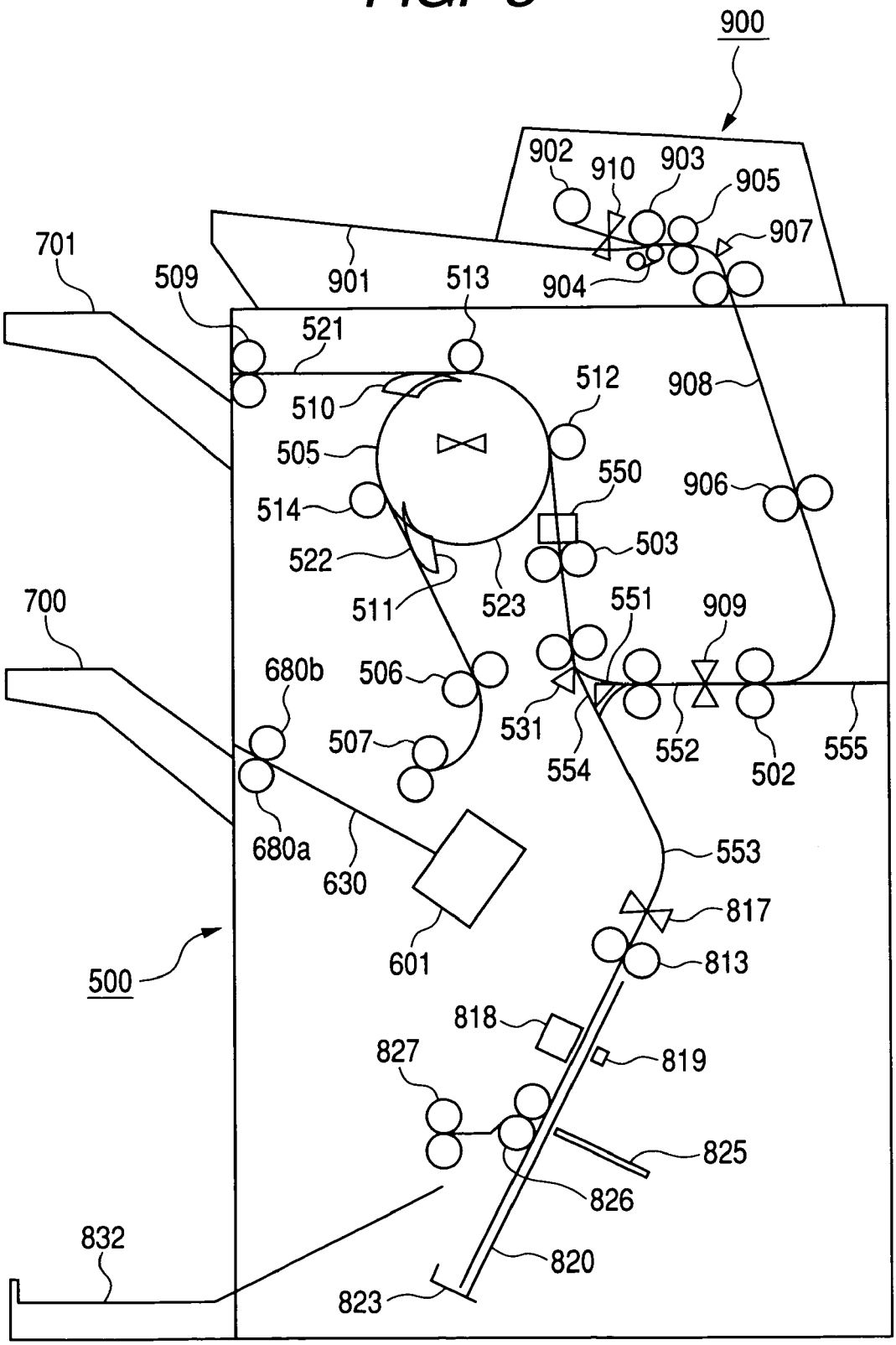
FIG. 3 is a longitudinal view typically showing the construction of the finisher 500 of FIG. 1.

The construction of the finisher 500 will now be described with reference to FIG. 3. FIG. 3 is a longitudinal cross-sectional view typically showing the construction of the finisher 500 of FIG. 1.

The finisher 500 effects various paper aftertreatments such as the treatment of introducing sheets discharged through the folding device 400 in succession, aligning the plurality of introduced sheets and bundling the sheets into a bundle, the stapling treatment of stapling the trailing edge of the sheet bundle by staples, the punching treatment of punching the vicinity of the trailing edge of the introduced sheets, a sorting treatment, a non-sorting treatment and a bookbinding treatment.

The finisher 500, as shown in FIG. 3, has an entrance conveying path 555 and a pair of entrance rollers 502 for directing the sheets discharged from the printer 300 through the folding device 400 thereinto. Downstream of the pair of entrance rollers 502, there is provided a changeover flapper 551 for directing the sheet to a finisher path 552 or a first bookbinding path 553.

The sheet directed to the finisher path 552 is sent toward a buffer roller 505 through a pair of conveying rollers 503. The pair of conveying rollers 503 and the buffer roller 505 are designed for forward and reverse rotation.

A sheet thickness detecting sensor 909 is provided at a location near the downstream side of the pair of entrance rollers 502. The details of this sheet thickness detecting sensor 909 will be described later. An entrance sensor 531 is provided between the pair of entrance rollers 502 and the pair of conveying rollers 503. Also, near the upstream side of the entrance sensor 531, a second bookbinding path 554 branches off from the finisher path 552. This branch-off point forms branching-off to a conveying path for conveying the sheet from the pair of entrance rollers 502 to the pair of conveying rollers 503, but forms branching-off having a one-way mechanism by which the sheet is conveyed only to the second bookbinding path 554 side when the pair of conveying rollers 503 are reversely rotated to thereby convey the sheet from the pair of conveying rollers 503 side to the entrance sensor 531 side.

A punch unit 55 having a puncher is provided between the pair of conveying rollers 503 and the buffer roller 505, and the punch unit 550 is operated as required to thereby punch the vicinity of the trailing edge of the sheet conveyed thereto.

The buffer roller 505 is a roller capable of laminating and twining a predetermined number of sheets sent thereto on the outer periphery thereof, and as required, the sheets are twined on the outer periphery of this roller by depressing runners 512, 513 and 514. The sheets twined on the buffer roller 505 are conveyed in the rotational direction of the buffer roller 505.

The twining of the sheets onto this buffer roller is effected when the succeeding sheet is temporarily buffered while the staple treatment is effected on the treatment tray 630, and the predetermined number of twined sheets are conveyed to the treatment tray 630 while remaining laminated at an appropriate time when he collision thereof against the preceding bundle does not occur.

A changeover flapper 510 is disposed between the depressing runners 513 and 514, and a changeover flapper 511 is disposed downstream of the depressing runner 514. The changeover flapper 510 is a flapper for stripping the sheets twined on the buffer roller 505 off from the buffer roller 505 and directing them to a non-sorting path 521 or a sorting path 522, and the changeover flapper 511 is a flapper for stripping the sheets twined on the buffer roller 505 off from the the buffer roller 505 and directing to the sorting path 522, or directing the sheets twined on the buffer roller 505 to a buffer path 523 while remaining twined.

The sheets directed to the non-sorting path 521 by the changeover flapper 510 are discharged onto a sample tray 701 through the pair of discharge rollers 509.

The sheets directed to the sorting path 522 by the changeover flapper 510 are stacked on an intermediate tray (hereinafter referred to as the treating tray) 630 through the conveying rollers 506 and 507. The sheets stacked in a bundle shape on the treatment tray 630 are subjected to aligning treatment, staple treatment, etc. as required, and thereafter are discharged onto a stacking tray 700 by discharge rollers 680*a* and 680*b*. A stapler 601 is used for the staple treatment which staples the sheets stacked in a bundle shape on the treating tray 630. The stacking tray is designed to be capable of moving up and down.

The sheets from the first bookbinding path 553 and the second bookbinding path 554 are contained in a containing guide 820 by a pair of conveying rollers 813, and are further conveyed until the leading edge of the sheets contacts with a movable type sheet positioning member 823. A bookbinding entrance sensor 817 is disposed upstream of a pair of conveying rollers 813. Also, two pairs of bookbinding staples 818 are provided at the midway position of the containing guide 820. The bookbinding staplers 818 are designed to cooperate with an anvil 819 opposed thereto to staple the sheet bundle at its center.

A pair of folding rollers 826 are provided at a location downstream of the bookbinding staplers 818. A protruding member 825 is provided at a location opposed to the pair of folding rollers 826. This protruding member 825 is protruded toward the sheet bundle contained in the containing guide 820, whereby this sheet bundle is pushed out into between the pair of folding rollers 826, and is folded by this pair of folding rollers 826, and thereafter is discharged onto a saddle discharge tray 832 through folded sheet discharging rollers 827. A bookbinding discharge sensor 830 is disposed downstream of the folded sheet discharging rollers 827.

Also, when the sheet bundle stapled by the bookbinding stapler 818 is to be folded, the positioning member 823 is moved down by a predetermined distance so that after the termination of the staple treatment, the stapled position of the sheet bundle may be the central position of the pair of folding rollers 826.

The inserter 900 is provided in the upper portion of the finisher 500, and successively separates the sheet bundle forming a cover or a slip sheet or the like which is a sheet to be inserted which is stacked on a tray 901, and conveys it to the finisher path 552 or the bookbinding path 553. Here, the sheet forming the cover or the slip sheet is stacked in a normal view state as viewed from the operator on the tray 901 of the inserter 900. That is, this sheet is stacked on the tray 901 with its front surface facing upwardly.

The sheets on this tray 901 are conveyed to a separating portion comprising a conveying roller 903 and a separating belt 904 by a feeding roller 902, and are separated one by one in succession from the uppermost sheet and are conveyed.

A pair of drawing-out rollers 905 are disposed downstream of this separating portion, and the sheet separated by the pair of drawing-out rollers 905 is stably directed to a conveying path 908 (inserted sheet conveying path). A feed sensor 907 is provided downstream of the pair of drawing-out rollers 905, and conveying rollers 906 for directing the sheet on the conveying path 908 to the pair of entrance rollers 502 are provided between the feed sensor 907 and the pair of entrance rollers 502.

Figure 4:
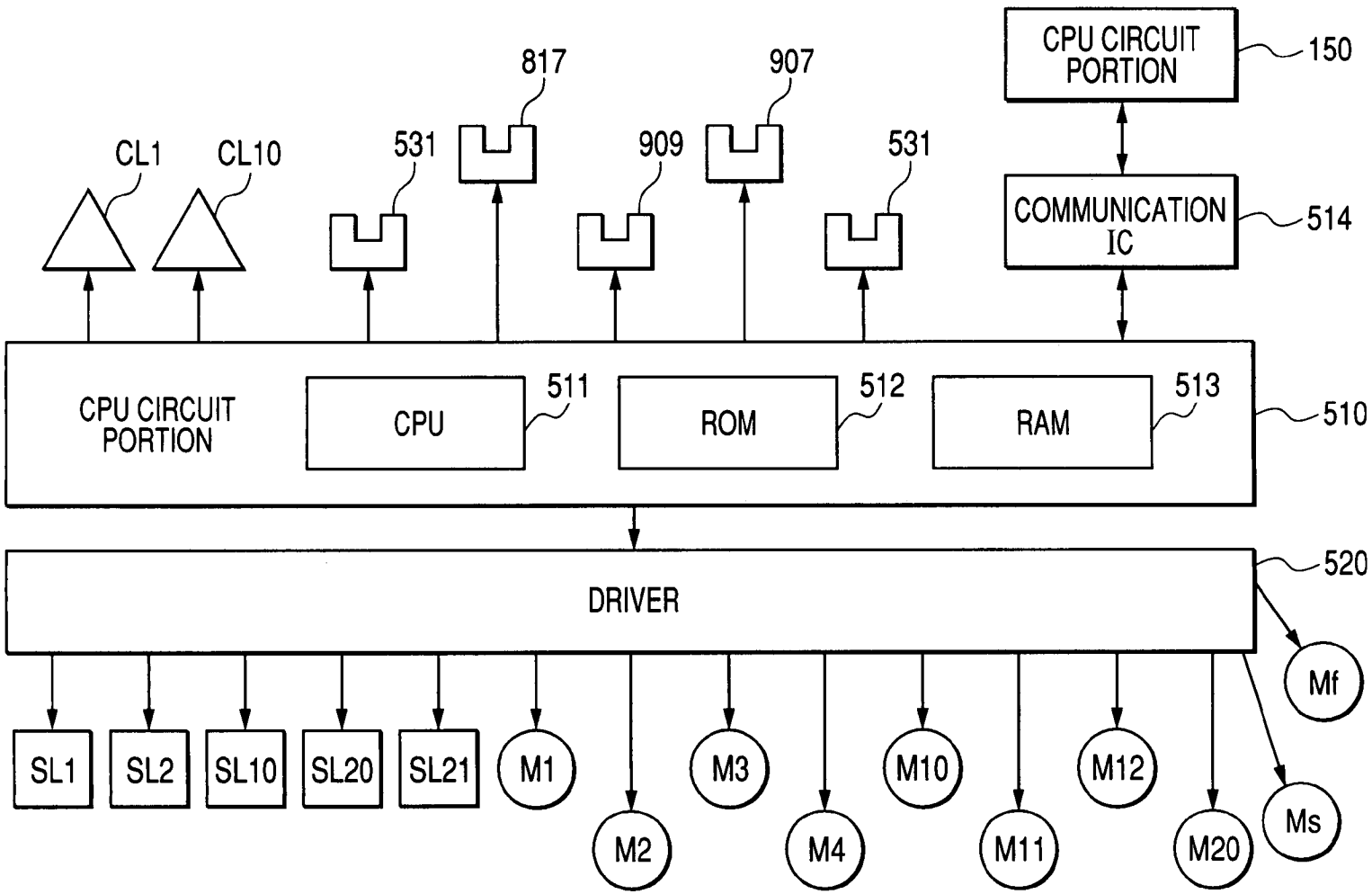
FIG. 4 is a block diagram showing the construction of the finisher controlling portion of FIG. 2.

The construction of a finisher controlling portion 501 for drive-controlling the finisher 500 will now be described with reference to FIG. 4. FIG. 4 is a block diagram showing the construction of the finisher controlling portion of FIG. 2.

The finisher controlling portion 501 as a controller has a CPU circuit portion 510 comprised of a CPU 511, a ROM 512, a RAM 513, etc. The CPU circuit portion 510 communicates with the CPU circuit portion 150 provided on the image forming apparatus main body side through a communication IC 514 and effects the exchange of data, and executes various programs stored in the ROM 512 on the basis of instructions from the CPU circuit portion 150 and effects the drive control of the finisher 500.

When this drive control is effected, detection signals from various sensors are introduced into the CPU circuit portion 510. These various sensors include the entrance sensor 531, a bookbinding entrance sensor 817, a sheet thickness detecting sensor 909, the feed sensor 907 and a sheet setting sensor 910. This sheet setting sensor 910 is a sensor for detecting whether special sheets are set on the tray 901 of the inserter 900. The sheet thickness detecting sensor 909, as described above, is provided on the finisher path 552 on which the entrance conveying path 555 for conveying the sheets from the folding device 400 and the conveying path 908 for conveying the sheets from the inserter 900 join together, and detects the thicknesses of the sheets passing on the finisher path 552.

A driver 520 is connected to the CPU circuit portion 510, and the driver 520 drives motors and solenoids on the basis of a signal from the CPU circuit portion 510. Also, the CPU circuit portion 150 drives clutches.

Here, the above-mentioned motors include an entrance motor M1 which is the drive source of the pair of entrance rollers 502, the pair of conveying rollers 503 and the pair of conveying rollers 906, a buffer motor M2 which is the drive source of the buffer roller 505, a discharge motor M3 which is the drive source of the pair of conveying rollers 506, the pair of discharge rollers 507 and the pair of discharge rollers 509, a bundle discharging motor M4 for driving the discharge rollers 680*a* and 680*b*, a conveying motor M10 which is the drive source of the pair of conveying rollers 813, a positioning motor M11 which is the drive source of the sheet positioning member 823, a folding motor M12 which is the drive source of the protruding member 825, the pair of folding rollers 826 and the pair of folded sheet discharging rollers 827, a feeding motor M20 which is the drive source of the feed roller 902, the conveying roller 903, the separating belt 904 and the pair of drawing-out rollers 905 of the inserter 900, a stapler motor Ms and a bookbinding stapler motor Mf which are the drive sources of the stapler 601 and the bookbinding stapler 818.

Each of the entrance motor M1, the buffer motor M2 and the discharge motor M3 comprises a stepping motor, and an excitation pulse rate can be controlled to thereby rotate the pair of rollers driven by each motor at a uniform speed, or at a peculiar speed. Also, the entrance motor Ml and the buffer motor M2 can be driven in forward and reverse rotational directions by the driver 520.

Each of the conveying motor M10 and the positioning motor M11 comprises a stepping motor, and the folding motor M12 comprises a DC motor. The conveying motor M10 is designed to be capable of conveying the sheets in synchronism with the speed of the entrance motor M1.

The feeding motor M20 comprises a stepping motor, and is designed to be capable of conveying the sheets in synchronism with the speed of the entrance motor M1.

The above-mentioned solenoids include a solenoid SL1 for effecting the changeover of the changeover flapper 510, a solenoid SL2 for effecting the changeover of the changeover flapper 511, a solenoid SL10 for effecting the changeover of the changeover flapper 551, a solenoid SL20 for driving the feed shutter (not shown in FIG. 3) of the inserter 900, and a solenoid SL21 for driving up and down the feed roller 902 of the inserter 900.

The above-mentioned clutches include a clutch CL1 for transmitting the drive of the folding motor M12 to the protruding member 825, and a clutch CL10 for transmitting the drive of the feeding motor M20 to the feed roller 902.

Figure 5A:
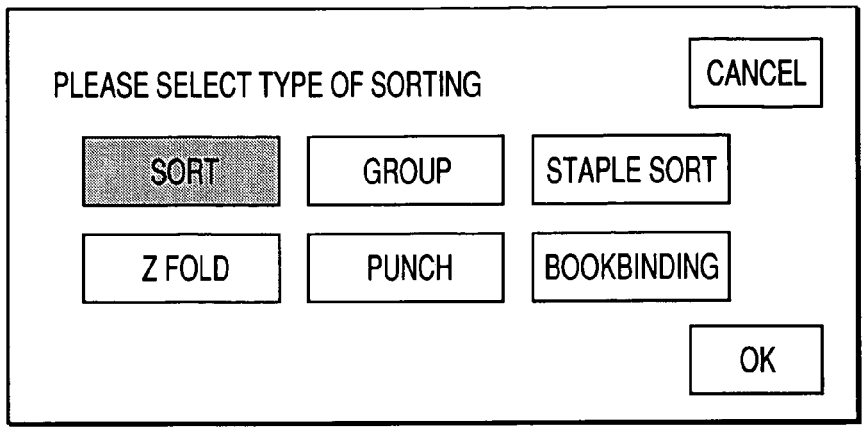
FIGS. 5A, 5B and 5C show examples of a screen regarding the aftertreatment mode selection of an operating portion in the image forming apparatus of FIG. 1.
Figure 5B:
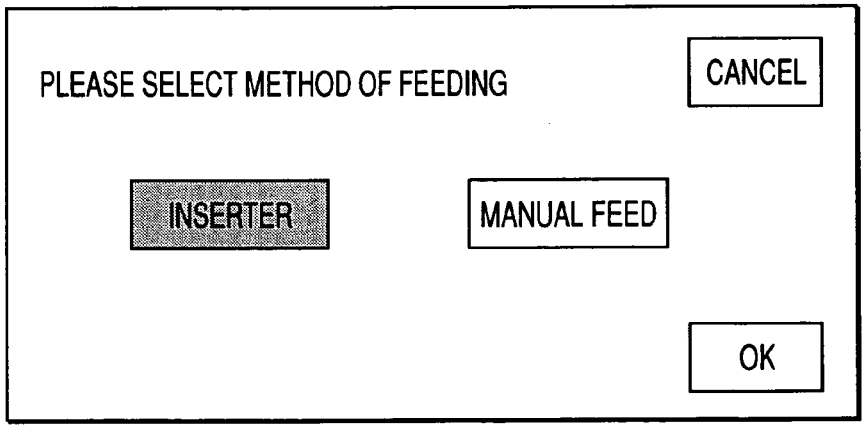
Figure 5C:
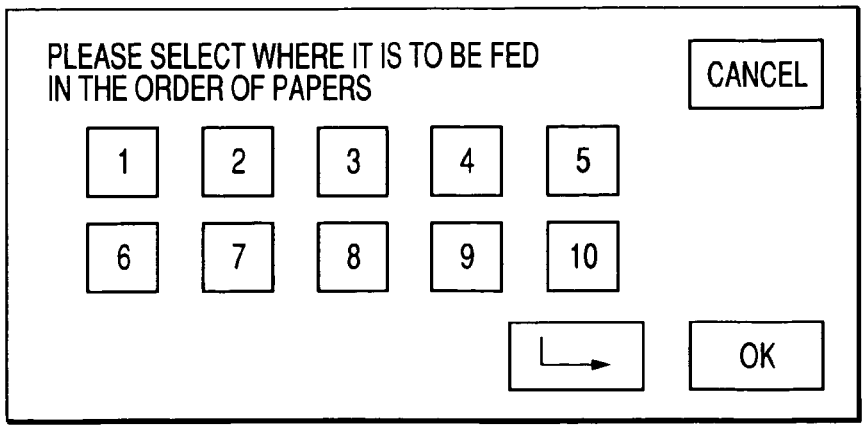

An example of the operation of selecting the aftertreatment mode by the use of the operating portion 153 will now be described with reference to FIGS. 5A, 5B and 5C. FIGS. 5A, 5B and 5C show examples of a screen regarding the selection of the aftertreatment mode by the operating portion in the image forming apparatus of FIG. 1.

This-image forming apparatus has treatment modes such as non-sorting, sorting, staple sorting (binding mode) and a bookbinding mode as aftertreatment modes, and is set so that a cover or the last sheet or sheets can be inserted midway with the inserted sheet as a slip sheet. The setting of such a treatment mode is effected by an inputting operation from the operating portion 153. For example, when setting the aftertreatment mode, the menu selecting screen shown in FIG. 5A is displayed on the operating portion 153, and the setting of the treatment mode is effected by the use of this menu selecting screen. Also, for example in case of the setting of a slip sheet mode, the screen shown in FIG. 5B is displayed on the insertion setting operation portion 153, and by the use of this screen, whether the insertion of an inserted sheet should be effected from the inserter 900 or from the manually feeding portion 125 is set, and where it is to be inserted in the order of sheets can be set on the screen shown in FIG. 5C. When only an inserted sheet forming a cover is to be fed, only "1" is selected, and when the umber of sheets to be inserted is plural, it is possible to select and set a desired sheet in the order of sheets.

The conveyance of the sheets from the inserter 900 and the printer 300 to the treating tray 630 in the finisher 500 during the sorting mode will now be described with reference to FIGS. 6 to 9. FIGS. 6 to 9 are views for illustrating the flow of the sheets from the inserter and the printer to the treatment tray in the finisher during the sorting mode in the image forming apparatus of FIG. 1. For the convenience of description, the bookbinding portion is omitted in these figures.

Figure 6:
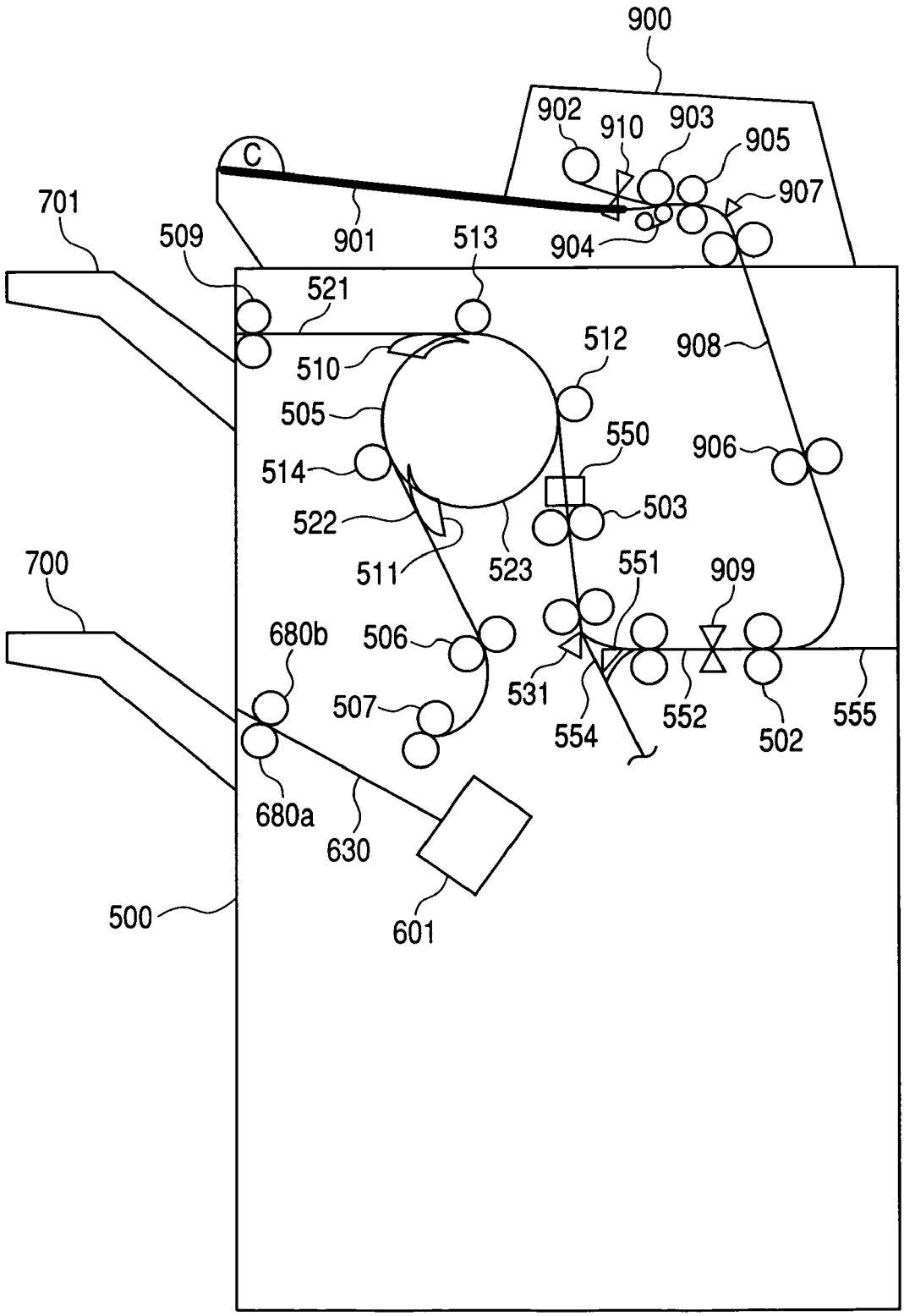
FIG. 6 is a view for illustrating the flow of sheets from an inserter and a printer to a treatment tray in the finisher during a sorting mode in the image forming apparatus of FIG. 1.
Figure 7:
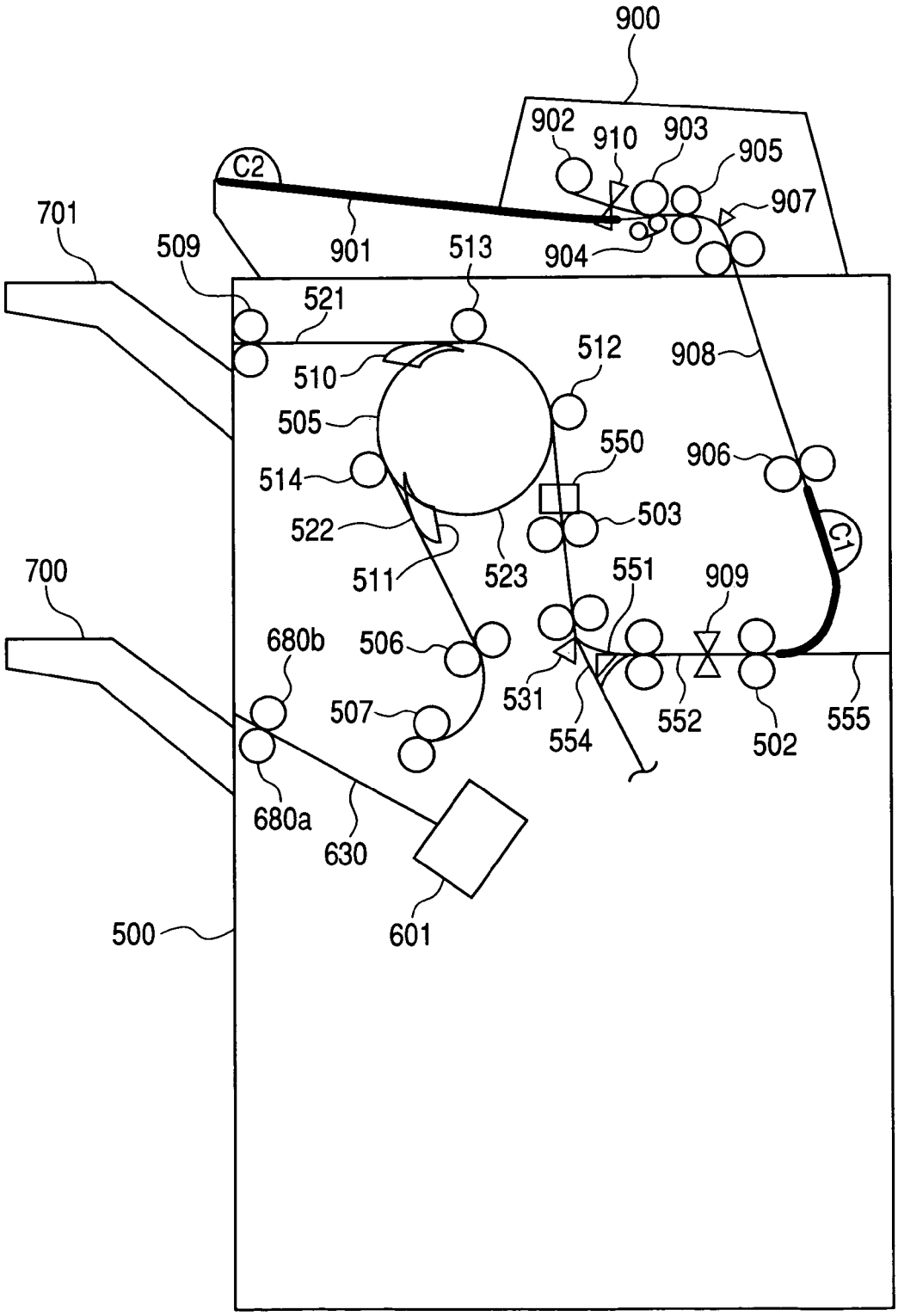
FIG. 7 is a view for illustrating the flow of the sheets from the inserter and the printer to the treatment tray in the finisher during the sorting mode in the image forming apparatus of FIG. 1.

When sheets C are to be inserted as a cover into the sheets after image forming, the sheets are set on the tray 901 of the inserter 900, as shown in FIG. 6. When the sheets C are set on the tray 901, the feeding of the uppermost sheet C1 is started as shown in FIG. 7, and the changeover flapper 551 is changed over to the finisher path 552 side. The sheet C1 is directed from the conveying path 908 into the finisher path 552 via the pair of entrance rollers 502, and when the leading edge of this sheet C1 is detected by the entrance sensor 531, the feeding of a sheet after image forming (sheet P1 shown in FIG. 8) from the printer 300 is started.

Then, the sheet P1 fed from the printer 300 is directed into the finisher 500 and also, the sheet C1 is directed to the sorting path 522 through the intermediary of the buffer roller 505. At this time, both of the changeover flappers 510 and 511 are changed over to the sorting path 522 side.

Figure 8:
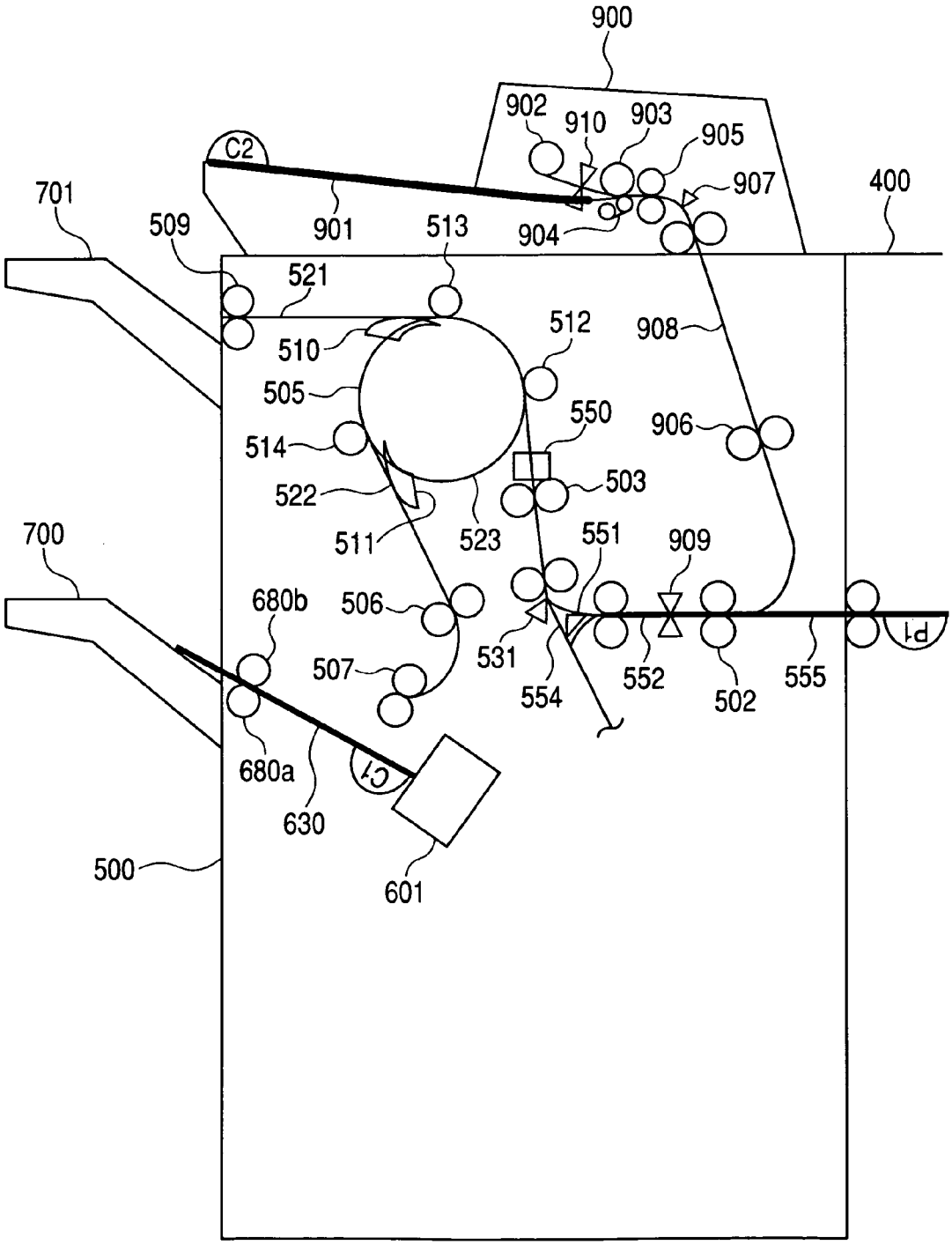
FIG. 8 is a view for illustrating the flow of the sheets from the inserter and the printer to the treatment tray in the finisher during the sorting mode in the image forming apparatus of FIG. 1.
Figure 9:
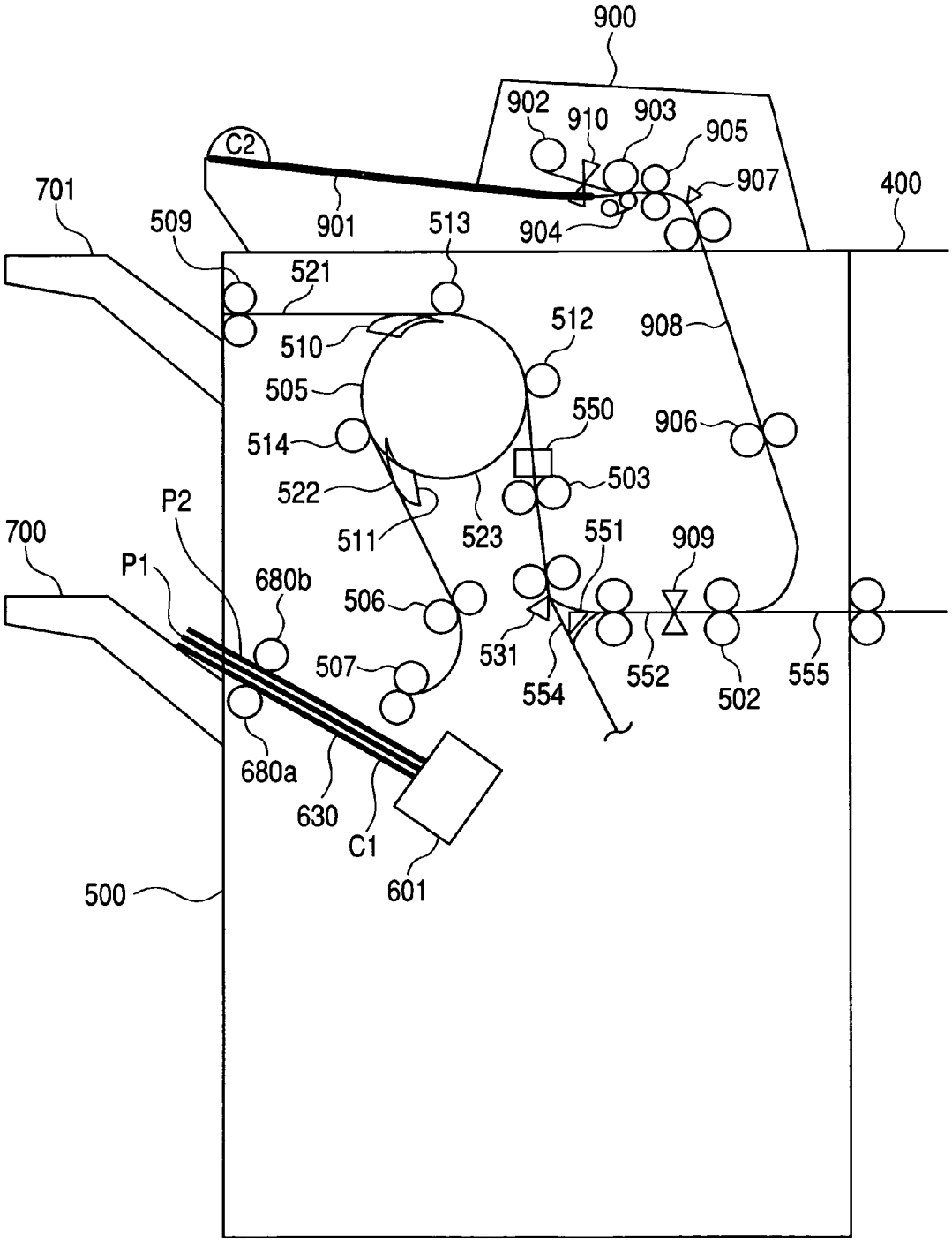
FIG. 9 is a view for illustrating the flow of the sheets from the inserter and the printer to the treatment tray in the finisher during the sorting mode in the image forming apparatus of FIG. 1.

The sheet C1 directed to this sorting path 522 is contained on the treatment tray 630, as shown in FIG. 8. At this time, the sheet P1 from the printer 300 is directed into the finisher path 522. This sheet P1, like the sheet C1, is directed to the sorting path 522 through the intermediary of the buffer roller 505, and is conveyed toward the treatment tray 630. Also, a sheet P2 succeeding to this sheet P1 is directed into the finisher path 552. Then, as shown in FIG. 9, the sheet P1 is superposed on the sheet C1 already contained on the treatment tray 630, and the succeeding sheet P2 is superposed on the sheet P1 and is contained.

Here, mirror-image-processed images are formed on the sheets P1 and P2 from the printer 300, and since the sheets P1 and P2 have been discharged by reversal discharge, the sheets P1 and P2, like the sheet C1, are contained on the treatment tray 630 with their image surfaces facing down and with their binding positions turned toward the stapler 601 side. Also, although not shown in FIG. 9, design is made such that when there is a sheet C to be inserted into the next bundle, this sheet C is fed to and stands by on the conveying path 908 during the feeding of the sheets P1 and P2 constituting the current bundle. By this construction, the productivity during the sorting mode treatment can be improved.

Figure 10:
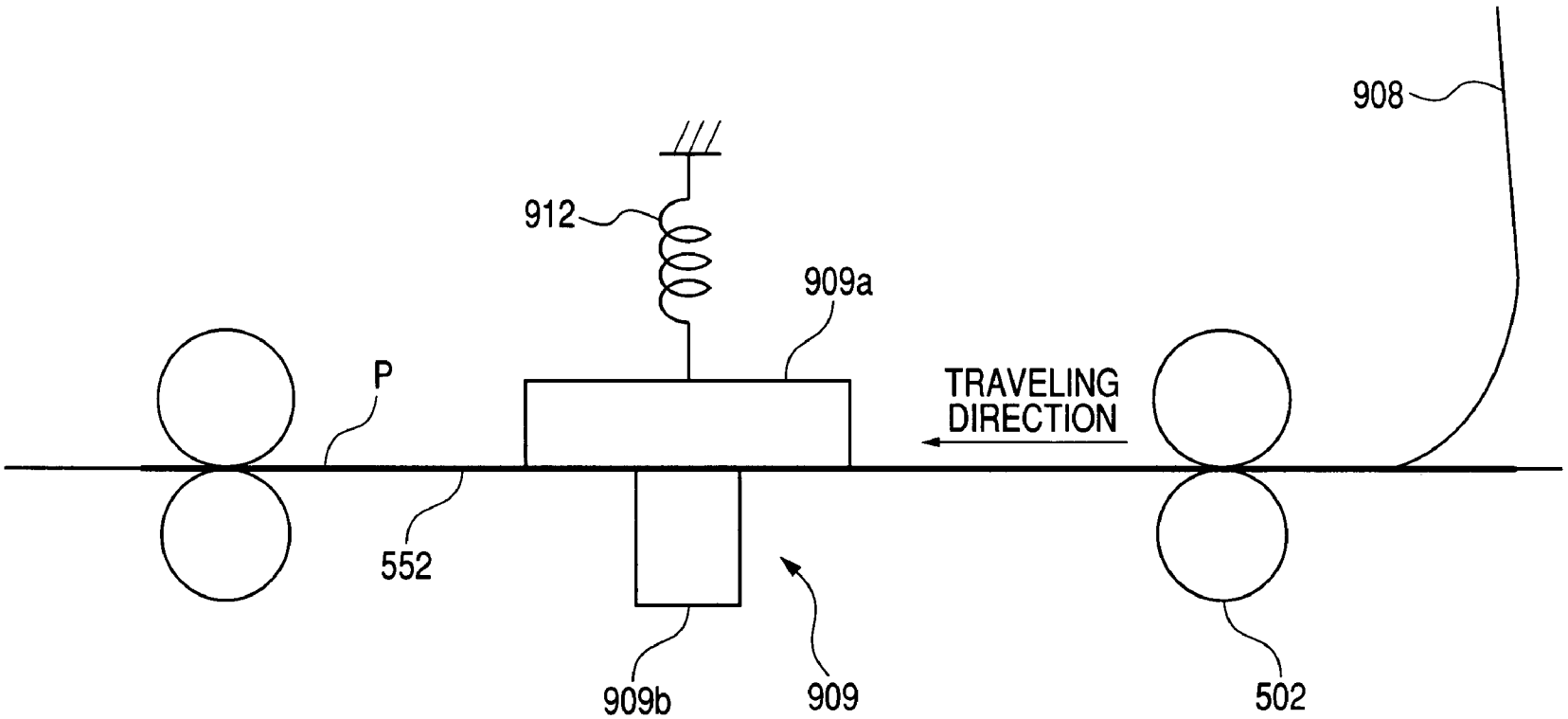
FIG. 10 typically shows the construction of the sheet thickness detecting sensor 909 of the finisher 500 of FIG. 3.
Figure 11:
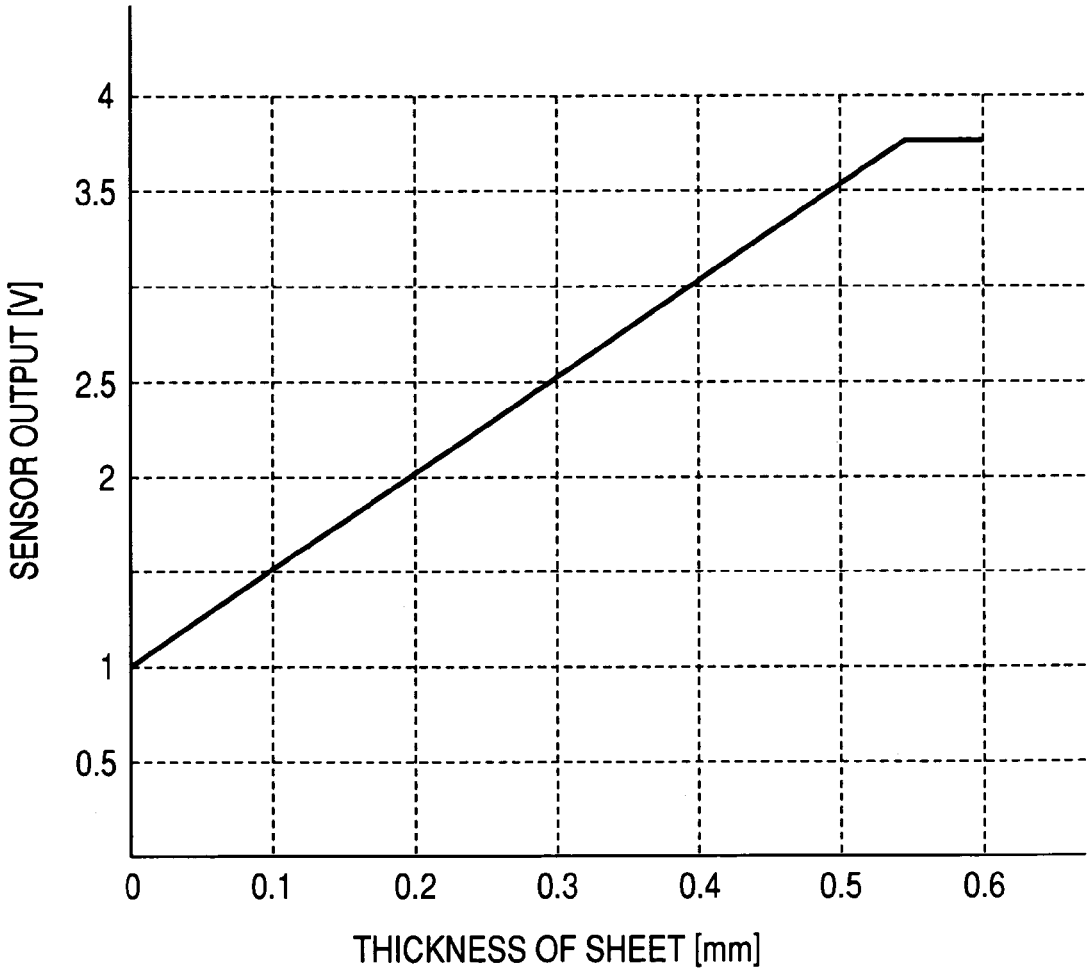
FIG. 11 shows the relation between the output signal of the relation between the output signal of the sheet thickness detecting sensor 909 of FIG. 10 and the sheet thickness.

The detailed construction of the sheet thickness detecting sensor 909 will now be described with reference to FIGS. 10 and 11. FIG. 10 typically shows the construction of the sheet thickness detecting sensor 909 of the finisher 500, and FIG. 11 is a graph showing the rotation between the output signal of the sheet thickness detecting sensor 909 of FIG. 10 and the thickness of the sheet.

The sheet thickness detecting sensor 909 is provided at a location near the downstream side of the pair of entrance rollers 502 in the finisher path 552. The sheet thickness detecting sensor 909 is comprised of a movable core 909*a* formed of a magnetic material, and a magnetic field sensor 909*b* disposed in opposed relationship with the movable core 909*a*, and using a Hall element. The movable core 909*a* is urged against the magnetic field sensor 909*b* side with a predetermined force by a spring 912. When a sheet P is directed into between this movable core 909*a* and the magnetic sensor 909*b* along the finisher path 552, the position of the movable core 909*a* is displaced in accordance with the thickness of the sheet P, and along therewith, the magnitude of a magnetic field produced by the movable core 909*a* changes. The change in the magnitude of this magnetic field is detected by the magnetic field sensor 909*b*. At this time, a signal outputted from the magnetic field sensor 909*b* becomes a signal conforming to the thickness of the sheet P, as shown in FIG. 11, and this signal is inputted as the output signal of the sheet thickness detecting sensor 909 to the A/D port (not shown) of the CPU circuit portion 510. The CPU circuit portion 510 calculates the thickness of the sheet P on the basis of the output signal of the sheet thickness detecting sensor 909 inputted through the A/D port. When for example, the output of the sheet thickness detecting sensor 909 is 1.5V, the thickness of the sheet P is calculated as 0.1 mm.

Figure 12:
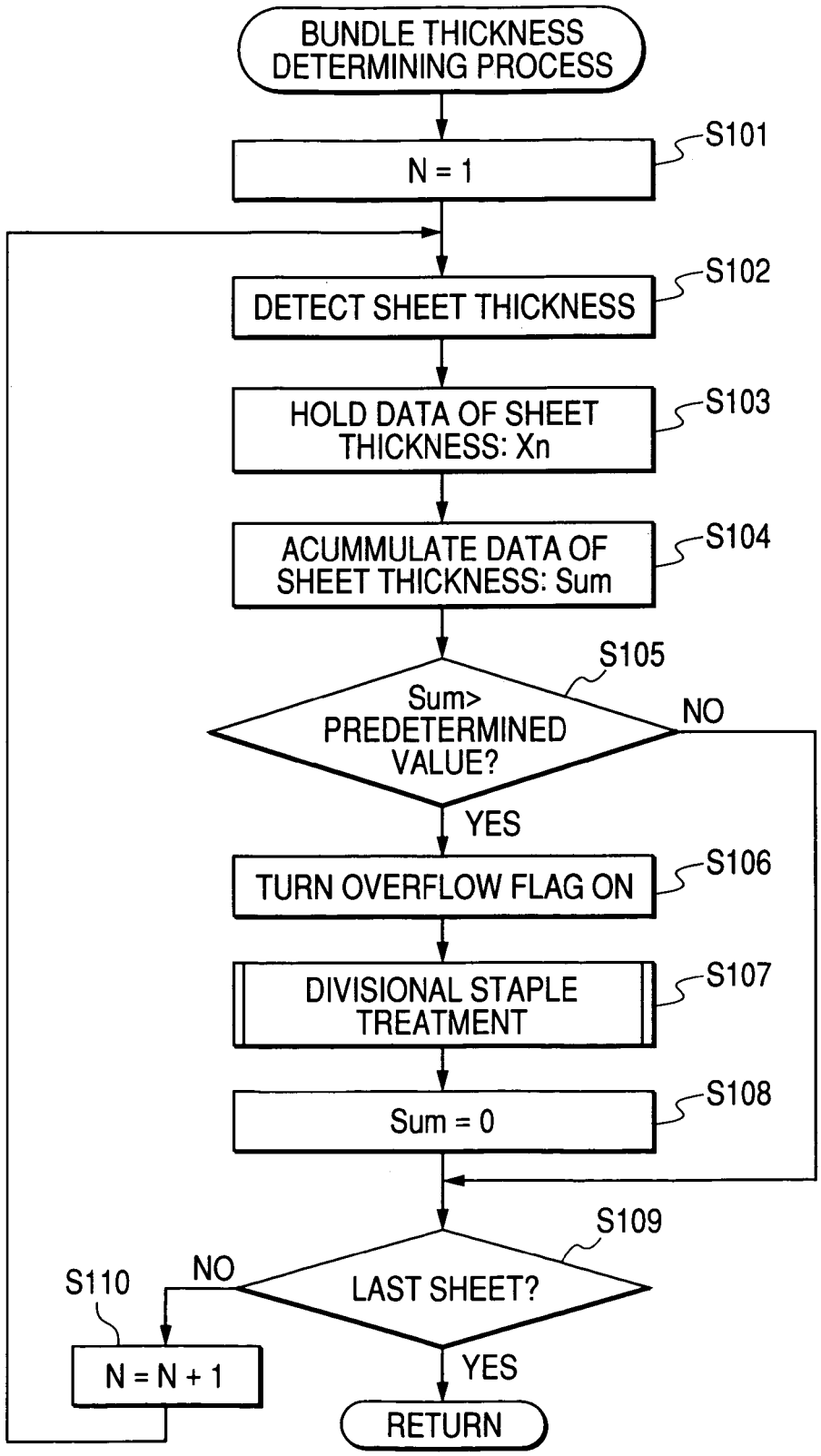
FIG. 12 is a flow chart showing the procedure of a bundle thickness determining process in the finisher 500 of FIG. 1.
Figure 13:
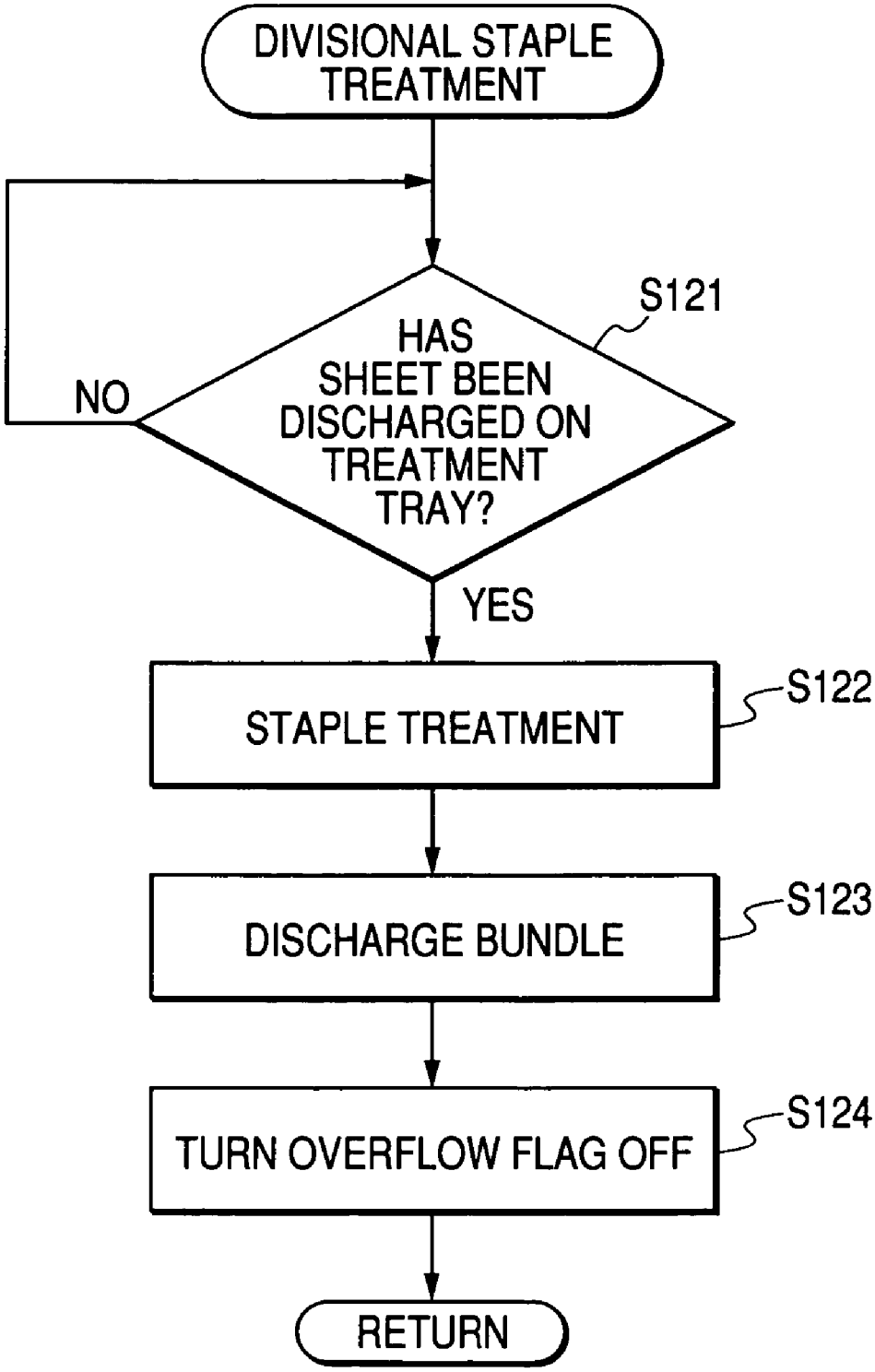
FIG. 13 is a flow chart showing the procedure of a divisional staple treatment at the step S107 of FIG. 12.

A bundle thickness determining process in the present embodiment will now be described with reference to FIGS. 12 and 13. FIG. 12 is a flow chart showing the procedure of the bundle thickness determining process in the finisher 500 of FIG. 1, and FIG. 13 is a flow chart showing the procedure of a divisional staple treatment at the step S107 of FIG. 12. The procedures shown in FIGS. 12 and 13 are executed in accordance with a program stored in the ROM 512, by the CPU 511 of the CPU circuit portion 510.

The bundle thickness determining process is executed when the aftertreatment mode (stapling, bookbinding, punching, etc.) has been set in the operating portion 153 of the image forming apparatus.

In the bundle thickness determining process, as shown in FIG. 12, the CPU 511 first sets 1 (the first sheet in the job) as a page variable N (step S101), and when a sheet (a sheet having an image formed thereon from the image forming apparatus main body 10 or a sheet from the inserter 900) passes the sheet thickness detecting sensor 909, the detection of the thickness of this sheet is effected (step S102). Subsequently, the CPU 511 temporarily holds sheet thickness data Xn (n is 1 in the case of the first sheet in the job) obtained from the output of the sheet thickness detecting sensor 909 in the RAM 513 (step S103). Then, the CPU 511 accumulates the sheet thickness data Xn held in the RAM 513 to thereby calculate a sheet thickness data accumulated value Sum which is the total of the thicknesses of all sheets having hitherto passed the sheet thickness detecting sensor 909 (step S104).

Then, the CPU 511 determines whether the sheet thickness data accumulated value Sum has reached a predetermined value is a value set small by the stapling capability of the stapler 601, i.e., a maximum thickness value capable of being stapled, and in the present embodiment, as the predetermined value, 10 mm is set from the stapling capability of the stapler 601. When the sheet thickness data accumulated value Sum has reached the predetermined value, the CPU 511 turns an overflow flag on (step S106), and executes the divisional staple treatment which will be described later (step S107). Then, the CPU 511, when the divisional staple treatment is executed, clears the sheet thickness data accumulated value Sum (step S108).

Then, the CPU 511 determines whether the sheet is the last sheet (step S109). If the sheet is not the last sheet, the CPU 511 increments the page variable N by 1 (step S110), and thereafter returns the process to the step S102. In contrast, if the sheet is the last sheet, the CPU 511 leaves this process.

If at the step S105, it is determined that the sheet thickness data accumulated value Sum has not reached the predetermined value, the CPU 511 skips the steps form the step S106 to the step S108, so that the process proceeds to the step S109.

In the divisional staple treatment of the step S107, as shown in FIG. 13, it is waited for for the sheet for which the CPU 511 has turned the overflow flag on to be discharged onto the treatment tray 630 (step S121), and when this sheet is discharged onto the treatment tray 630, the CPU 511 executes the staple treatment at a preset stapling position in the sheet bundle on the treating tray 630 (step S122). Then, the CPU 511 controls the sheet bundle subjected to the staple treatment so as to be discharged onto the stacking tray 700 (step S123), and when the sheet bundle is discharged onto the stacking tray 700, the CPU 511 turns the overflow flag off (step S124). Then, the CPU 511 leaves this treatment.

When by the above-described treatment, the thickness of the sheet bundle reaches a predetermined value (10 mm in the present embodiment) during the job, the divisional staple mode in which the staple treatment is effected on a sheet bundle of which the thickness has reached the predetermined value is executed and therefore, the buckling or jam of staple needles attributable to the thickness of the sheet bundle can be obviated. When this divisional staple treatment has been executed, a plurality of sheet bundles stapled by the stapler 601 are obtained for the job concerned.

Also, after the divisional staple treatment for the sheet bundle of which the thickness has reached a predetermined value (10 mm in the present embodiment) at first, when the thickness of a sheet bundle including subsequent sheets reaches the predetermined value, the divisional staple treatment is likewise effected.

When the overflow flag is turned on, treatments for effecting the divisional staple treatment, i.e., a staple treatment and a discharging treatment to the stacking tray 700, occur due to interruption. When this overflow flag has been turned on, the next sheet is already fed form the image forming apparatus main body 10 and therefore, if the next sheet is intactly discharged onto the treatment tray 630, the next sheet will come to collide against a sheet bundle being under divisional staple treatment. Therefore, the next sheet is twined on and buffered by the buffer roller 505 of the finisher 500, whereby the collision of the next sheet against the sheet bundle being under staple treatment is prevented.

Also, in the above-described treatment, although not shown, in a case where during the job, the thickness of a sheet bundle including the first sheet to the last sheet does not reach the predetermined value, an ordinary staple treatment is effected. Also, in a case where after the divisional staple treatment has been effected during the job, the thickness of a sheet bundle including the last sheet does not reach the predetermined value, the ordinary staple treatment is likewise effected.

In a case where in the present embodiment, the thickness of the sheet bundle reaches the predetermined value or greater during the job and the overflow flag has been turned on, the job may be temporarily discontinued after the treatment of this sheet bundle has been finished, and a message pressing the user for the resetting of a copy mode (such as a two-side mode) may be displayed on the operating portion 153. In this case, after the resetting of the copy mode has been effected by the user, a start key is depressed, whereby the job for the second and subsequent bundles is resumed on the basis of the reset mode. By doing so, the user can change the copy mode to the two-side mode or release the staple mode so that the thickness of the sheet bundle may be within the-predetermined value and therefore, the usability to the user can be improved.

Second Embodiment

Figure 14:
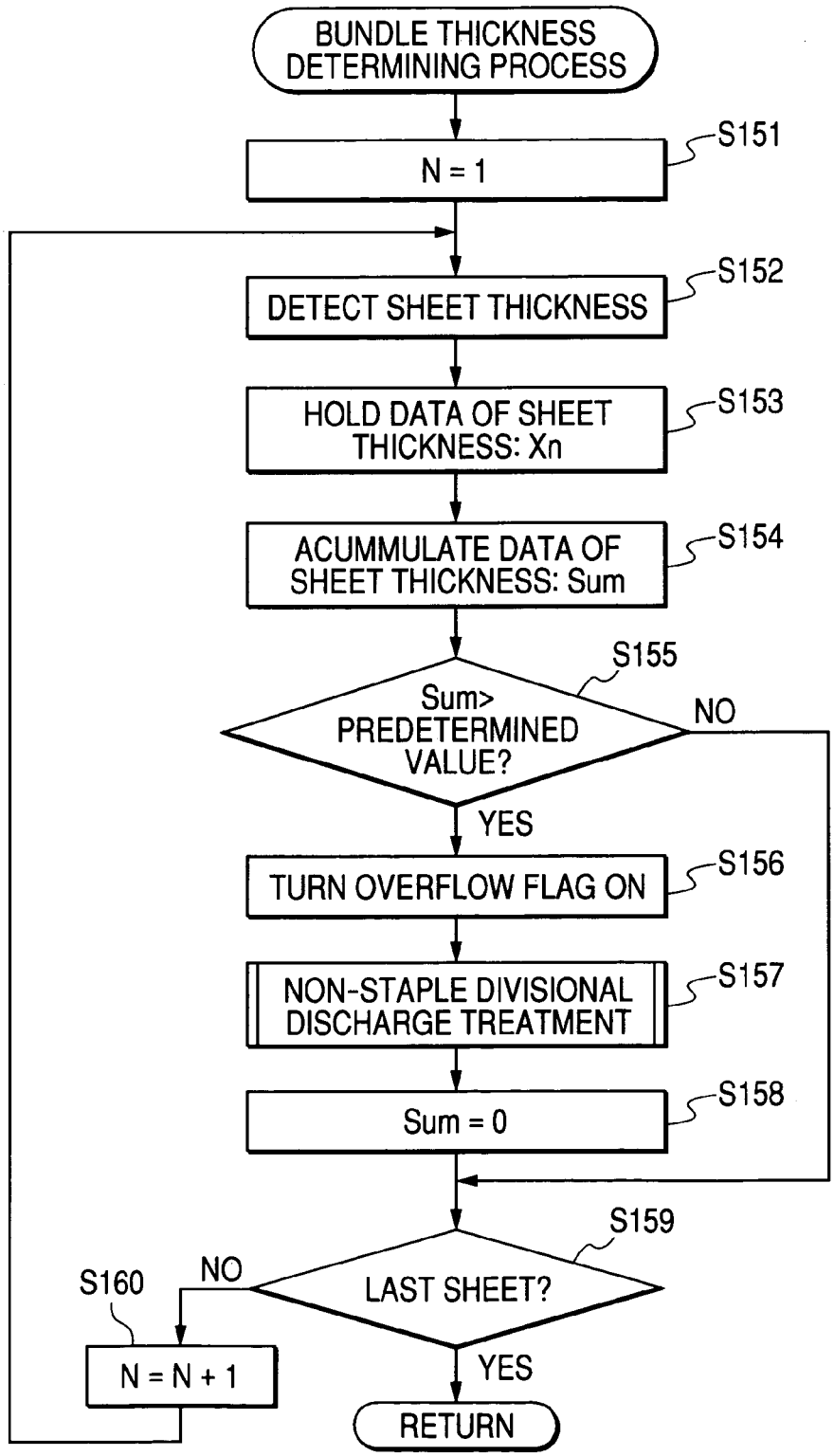
FIG. 14 is a flow chart showing the procedure of a bundle thickness determining process in a finisher as an aftertreatment apparatus according to a second embodiment of the present invention.
Figure 15:
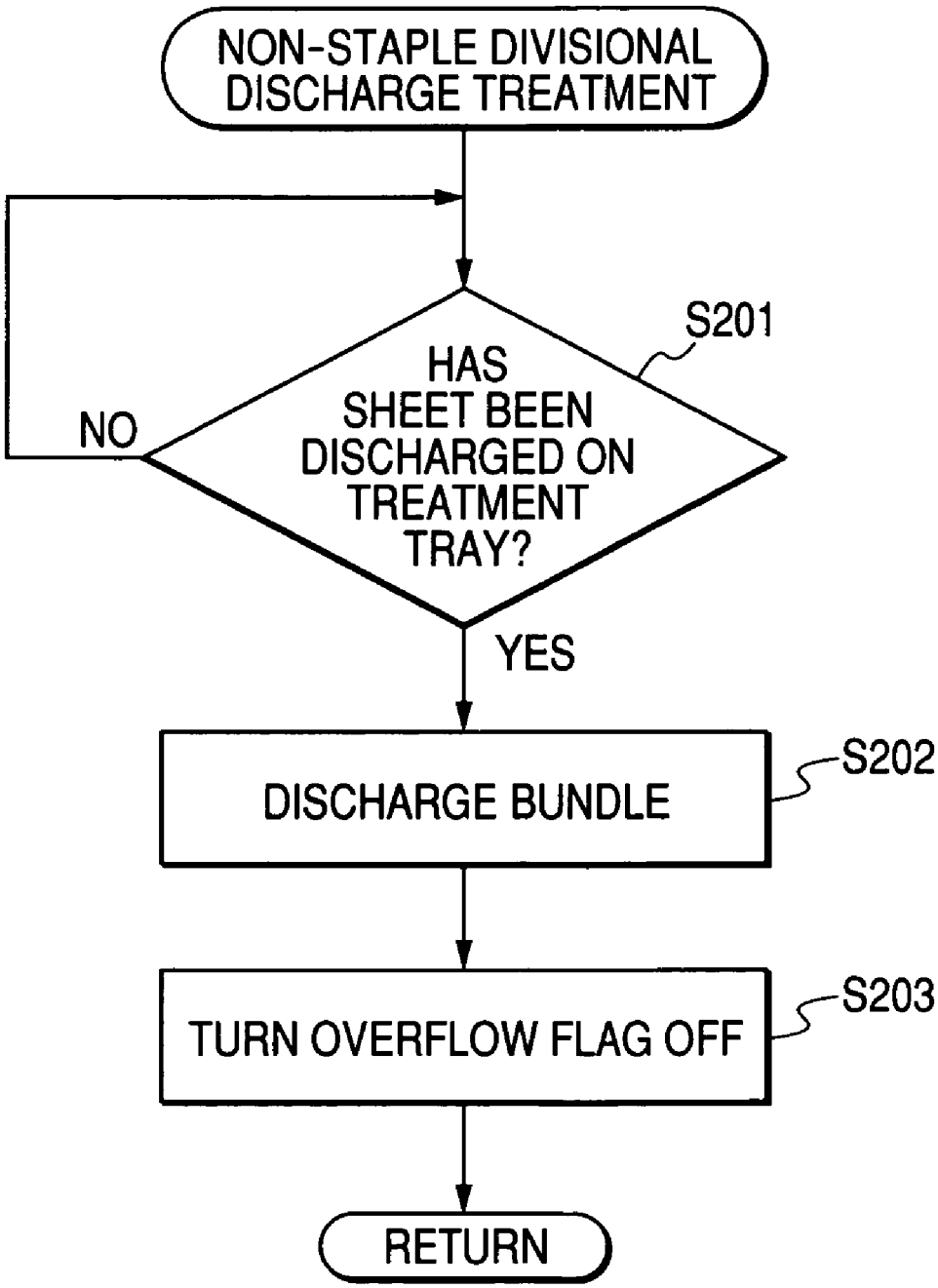
FIG. 15 is a flow chart showing the procedure of a non-staple divisional discharge treatment at the step S157 of FIG. 14.

A second embodiment of the present invention will now be described with reference to FIGS. 14 and 15. FIG. 14 is a flow chart showing the procedure of a bundle thickness determining process in a finisher as an aftertreatment apparatus according to the second embodiment of the present invention, and FIG. 15 is a flow chart showing the procedure of a non-staple divisional discharge treatment at the step S157 of FIG. 14.

In the above-described first embodiment, when thickness of a sheet bundle has reached the predetermined value or greater during a job, the divisional staple treatment is effected. In contrast, in the present embodiment, when the thickness of a sheet bundle has reached the predetermined value or greater during a job, the divisional staple treatment is not effected, but control is effected so that a sheet bundle of which the thickness has reached the predetermined value or greater may be bundle-discharged while remaining non-stapled. The present embodiment has the same construction as that of the above-described first embodiment, and here, only the differences of the present embodiment from the first embodiment will be described.

Specifically, as shown in FIG. 14, the CPU 511 first sets 1 (the first sheet in the job) as a page variable N (step S151), and the detection of the thickness of a sheet having passed the sheet thickness detecting sensor 909 is effected (step S152). Subsequently, the CPU 511 temporarily holds sheet thickness data Xn obtained from the output of the sheet thickness detecting sensor 909 in the RAM 513 (step S153). Then, the CPU 511 accumulates the sheet thickness data Xn held in the RAM 513 to thereby calculate a sheet thickness data accumulated value Sum which is the total of the thicknesses of all sheets having hitherto passed the sheet thickness detecting sensor 909 (step S154).

Then, the CPU 511 determines whether the sheet thickness data accumulated value Sum has reached the predetermined value (step S155). If the sheet thickness data accumulated value Sum has reached the predetermined value, the CPU 511 turns the overflow flag on (step S156), and executes the non-staple divisional discharge treatment which will be described later (step S157). Then, when the non-staple divisional discharge treatment is executed, the CPU 511 clears the sheet thickness data accumulated value Sum (step S158).

Then, the CPU 511 determines whether the sheet is the last sheet (step S159). If here, the sheet is not the last sheet, the CPU 511 increments the page variable N by 1 (step S160), and thereafter returns the treatment to the step S102. In contrast, if the sheet is the last sheet, the CPU 511 leaves this process.

If at the step S155, it is determined that the sheet thickness data accumulated value Sum has not reached the predetermined value, the CPU 511 skips the steps form the step S156 to the step S158 so that the process proceeds to the step S159.

In the non-staple divisional discharge treatment of the step S157, as shown in FIG. 15, first, it is waited for for the sheet for which the CPU511 has turned the overflow flag on to be discharged onto the treatment tray 630 (step S201), and when this sheet is discharged onto the treatment tray 630, a staple mode set so as to be executed for the sheet bundle on the treating tray 630 is inhibited, and control is effected so that the sheet bundle may be discharged onto the stacking tray 700 in its non-stapled state (step S202). Then, when the sheet bundle is discharged onto the stacking tray 700, the CPU 511 turns the overflow flag off (step S203), and leaves this treatment.

When the thickness of the sheet bundle reaches the predetermined value or greater during the job, the staple treatment is inhibited by the above-described process and therefore, the buckling or jam of staple needles attributable to the thickness of the sheet bundle can be obtained. When the thickness of the sheet bundle has reached the predetermined value or greater during the job, the finally obtained sheet bundle in the job becomes plurality of non-stapled sheet bundles including a non-stapled sheet bundle of which the thickness has reached the predetermined value.

Third Embodiment

Figure 16:
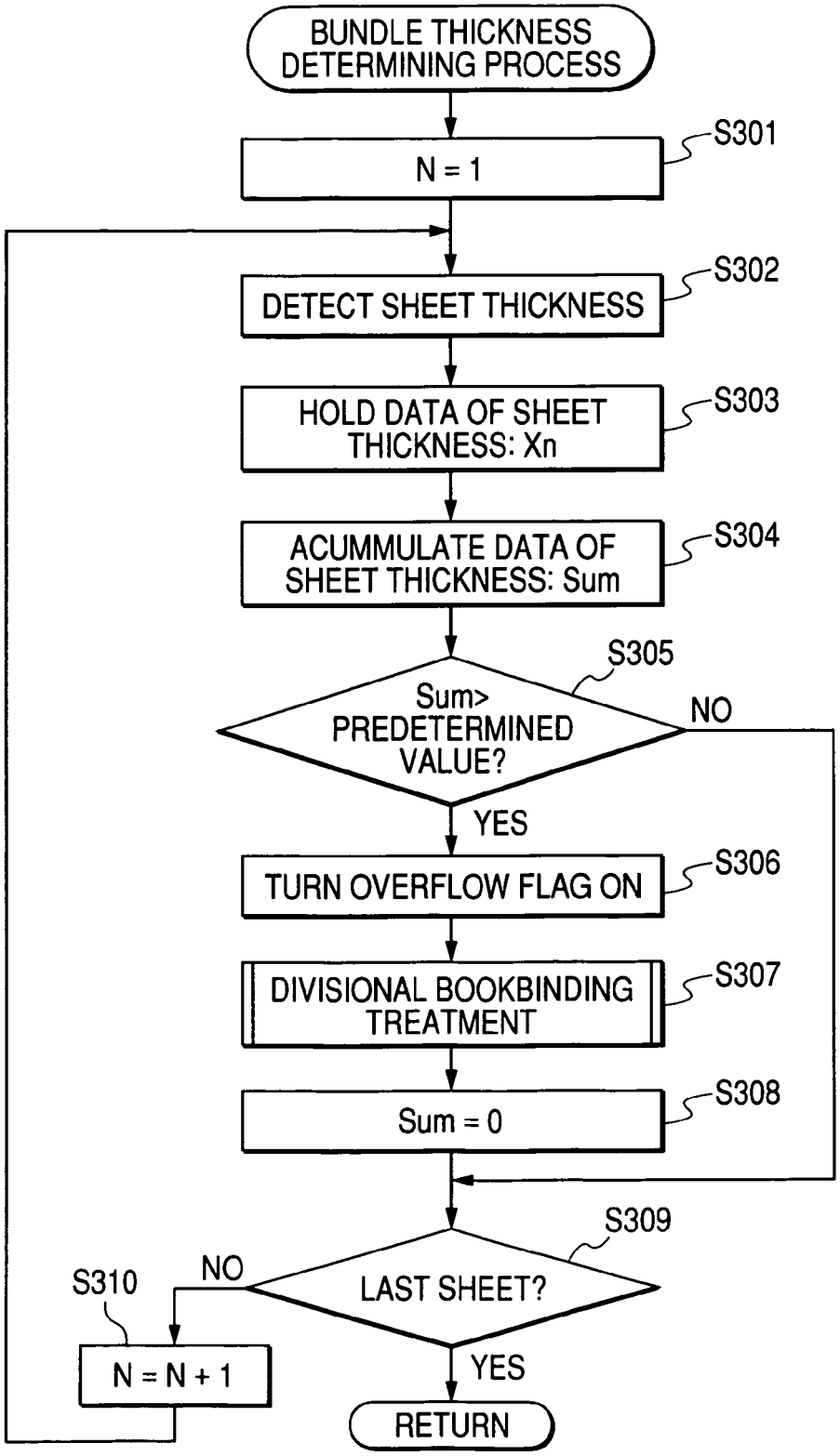
FIG. 16 is a flow chart showing the procedure of a bundle thickness determining process in a finisher as an aftertreatment apparatus according to a third embodiment of the present invention.
Figure 17:
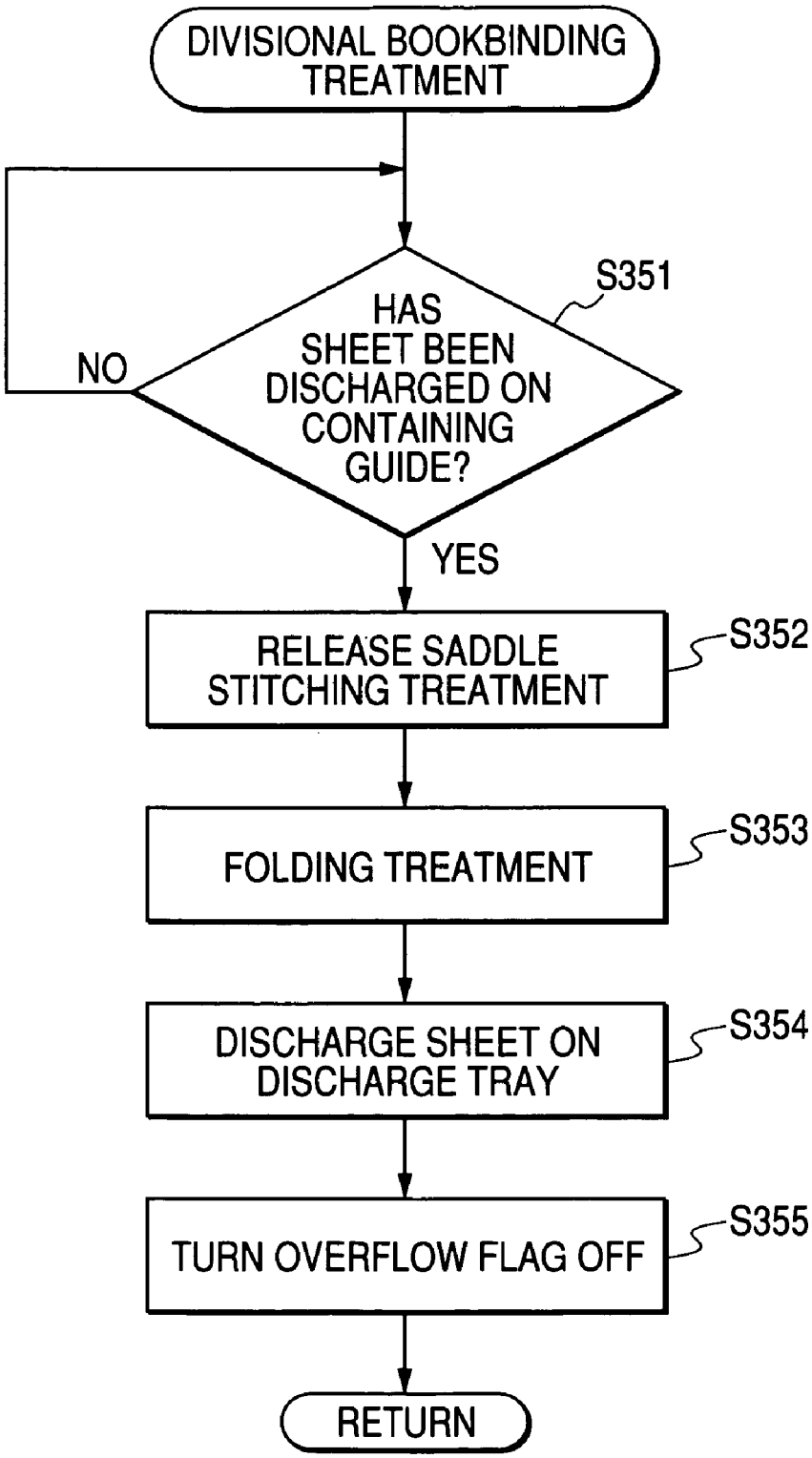
FIG. 17 is a flow chart showing the procedure of a divisional bookbinding treatment at the step S307 of FIG. 16.

A third embodiment of the present invention will now be described with reference to FIGS. 16 and 17. FIG. 16 is a flow chart showing the procedure of a bundle thickness determining process in a finisher as an aftertreatment apparatus according to the third embodiment of the present invention, and FIG. 17 is a flow chart showing the procedure of a divisional bookbinding treatment at the step S307 of FIG. 16. The present embodiment has the same construction as that of the above-described first embodiment, and here, only the differences of the present embodiment from the first embodiment will be described.

In the present embodiment, in a case where a bookbinding mode is set as the aftertreatment mode, when the thickness of a sheet bundle reaches a predetermined value during a job, a bundle thickness determining process for executing the divisional bookbinding treatment is carried out.

In the bundle thickness determining process, as shown in FIG. 16, the CPU 511 first sets 1 (the first sheet in the job) as the page variable N (step S301), and when a sheet passes the sheet thickness detecting sensor 909, the detection of the thickness of this sheet is effected (step S302). Subsequently, the CPU 511 temporarily holds sheet thickness data Xn obtained from the output of the sheet thickness detecting sensor 909 in the RAM 513 (step S303). Then, the CPU 511 accumulates the sheet thickness data Xn held in the RAM 513 to thereby calculate a sheet thickness data accumulated value Sum which is the total of the thicknesses of all sheets having hitherto passed the sheet thickness detecting sensor 909 (step S304).

Then, the CPU 511 determines whether the sheet thickness data accumulated value Sum has reached a predetermined value (step S305). Here, the predetermined value is a value in the bookbinding mode which has been determined from the stapling capability of the bookbinding stapler 818. For example, 2 mm is set as the above-mentioned predetermined value. When the sheet thickness data accumulated value Sum has reached the predetermined value, the CPU 511 turns the overflow flag on (step, S306), and executes a divisional bookbinding treatment which will be described later (step S307). Then, when the divisional staple treatment is executed, the CPU 511 clears the sheet thickness data accumulated value Sum (step S308).

Then, the CPU 511 determined whether the sheet is the last sheet (step S309). Here, if the sheet is not the last sheet, the CPU 511 increments the page variable N by 1 (step S310), and thereafter returns the process to the step S302. In contrast, if the sheet is the last sheet, the CPU 511 leaves this process.

If at the step S305, it is determined that the sheet thickness data accumulated value Sum has not reached the predetermined value, the CPU 511 skips the steps from the step S306 to the step S308 so that the process proceeds to the step S309.

In the divisional bookbinding treatment of the step S307, as shown in FIG. 17, first, it is waited for for the sheet for which the CPU 511 has turned the overflow flag on to be discharged onto the containing guide 820 (step S351), and when this sheet is discharged onto the containing guide 820, the CPU 511 releases the staple treatment set for a sheet bundle contained in the containing guide 820 (step S352). Then, the CPU 511 effects a folding treatment of folding the sheet bundle in two at the central portion thereof (step S353), and controls the twice-folded sheet bundle so as to be discharged onto the discharge tray 832 (step S354). When this sheet bundle is discharged, the CPU 511 turns the overflow flag off (step S355), and leaves this process.

When by the above-described treatment, the thickness of the sheet bundle reaches the predetermined value during the job, the staple treatment for the sheet bundle of which the thickness has reached the predetermined value by the divisional bookbinding treatment is released and therefore, the occurrence of the buckling or jam of the staple needles attributable to the thickness of the sheet bundle can be obviated.

Also, description has been made of an embodiment in which the predetermined value is determined from the stapling capability of the bookbinding stapler 818, but the predetermined value may be determined on the basis of the capability of the pair of folding rollers 826. In the folding treatment, the situation that a sheet bundle having a thickness greatly exceeding the predetermined value is folded can be avoided, and a great load can be obviated from being applied to the folding treatment.

Fourth Embodiment

Figure 18:
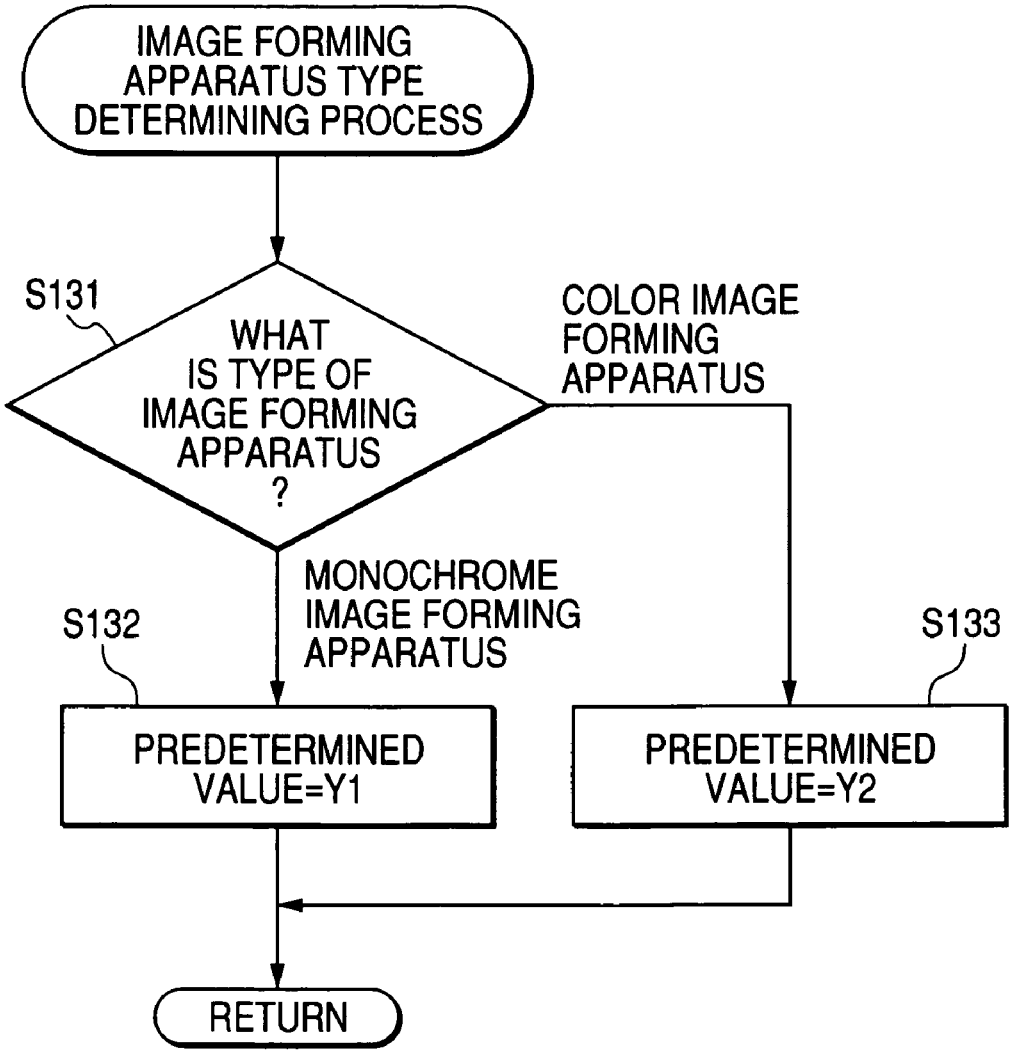
FIG. 18 is a flow chart showing the procedure of an image forming apparatus type determining process in a finisher as an aftertreatment apparatus according to a fourth embodiment of the present invention.

A fourth embodiment of the present invention will now be described with reference to FIG. 18. FIG. 18 is a flow chart showing the procedure of an image forming apparatus type determining process in a finisher as an aftertreatment apparatus according to the fourth embodiment of the present invention. The present embodiment has the same construction as that of the above-described first embodiment, and here, only the differences of the present embodiment from the first embodiment will be described.

In each of the above-described embodiments, the predetermined value as the reference for determining whether the divisional staple treatment, the non-staple divisional treatment or the divisional bookbinding treatment should be effected is determined from the capability of the stapler, but depending on the types of sheets used by the image forming apparatus, a force necessary for stapling differs even for the same sheet thickness. Generally, in a color image forming apparatus and a monochrome image forming apparatus, sheets differing in density are used, and this difference in density may give rise to a case where when a bundle of sheets having the same thickness is to be stapled by one and the same stapler, the thickness of a sheet bundle capable of being stapled by this stapler differs depending on sheets used in the respective image forming apparatuses.

Consequently, the present embodiment carries out the image forming apparatus type determining process in order to change over a predetermined value for the thickness of the sheet bundle in accordance with whether the image forming apparatus connected to the finisher 500 is a monochrome image forming apparatus or a color image forming apparatus.

In the image forming apparatus type determining process, as shown in FIG. 18, when a power supply switch is turned on, the CPU 511 first determines the type of the image forming apparatus connected to the finisher 500 (step S131). Here, if the connected image forming apparatus is a monochrome image forming apparatus, the CPU 511 sets Y1 as the predetermined value (step S132). Then, the CPU 511 leaves this process. In contrast, if the connected image forming apparatus is a color image forming apparatus the CPU 511 sets Y2 as the predetermined value (step S133). Then, the CPU 511 leaves this process.

In the present embodiment, as the predetermined value as the reference for determining whether the divisional staple treatment should be effected, for example, 10 mm is set as the predetermined value Y1, and 8 mm is set as the predetermined value Y2.

In this manner, it becomes possible to carry out the bundle thickness determining process of each of the above-described embodiments by the use of the predetermined value set in accordance with the type of the image forming apparatus.

In each of the above-described embodiments, the treatment using the stapler has been described as an example of the aftertreatment, but of course, the treatment of each of the above-described embodiment is also applicable in the case of the punching treatment in which collective punching is effected on the sheet bundle by the punch unit 550.

Also, in each of the above-described embodiments, description has been made of a case where a sheet forming a cover or a slip sheet is fed from the inserter 900, but of course, it is also possible to likewise apply the bundle thickness treatment of each embodiment to a case where a sheet forming a cover or a slip sheet is fed from the image forming apparatus main body 10.

Also, in any one of the above-described embodiments, as the sheet thickness detecting sensor, there has been shown by way of example one comprised of the movable core 909*a* formed of a magnetic material, and the magnetic field sensor 909*b* disposed in opposed relationship with the movable core 909*a* and using a Hall element. The sheet thickness detecting sensor, however, can be any sensor which is provided in the finisher path 552 which is a common conveying path and which detects the thickness of each sheet conveyed through the finisher path 552. For example, as the sheet thickness detecting sensor, provision may be made of a pair of ultrasonic type sensors in such a manner as to sandwich the conveying path therebetween, and an ultrasonic wave may be emitted to a sheet conveyed on the conveying path, and the ultrasonic wave transmitted through the sheet may be detected to thereby detect the thickness of the sheet. Also, there may be adopted a construction in which one of a pair of rollers for nipping and conveying a sheet is made movable, and a sensor for detecting the amount of movement of the roller moved in accordance with the thickness of the sheet conveyed between the rollers is provided as the sheet thickness detecting sensor. Also, there may be adopted a construction in which as the sheet thickness detecting sensor, a light emitting sensor element and a light receiving element are provided so as to sandwich the conveying path therebetween, and the quantity of light transmitted through a sheet and changed by the thickness of the sheet is detected by the light receiving element to thereby detect the thickness of the sheet.

Also, while in each of the above-described embodiments, there has been shown by way of example a construction in which the control for the finisher 500 is effected by the finisher controlling portion 501, design may be made such that each device constituting the entire image forming apparatus is controlled by only the CPU circuit portion 150.

Also, of course, the object of the present invention is achieved by supplying a system or an apparatus with a storage medium (or a recording medium) having recorded therein the program code of software which realizes the functions of the aforedescribed embodiments, and the computer (or the CPU or the MPU) of the system or the apparatus reading out and executing the program code stored in the storage medium. In this case, the program code itself read out form the storage medium comes to realize the functions of the aforedescribed embodiments and thus, the storage medium storing the program code therein constitutes the present invention.

Also, as the storage medium for supplying the program code, use can be made, for example, of a Floppy (registered trademark) disk, a hard disk, a magneto-optical disk, CD-ROM, CD-R, CD-RW, DVD-ROM, DVD-RAM, DVD–RW, DVD+RW, a magnetic tape, a non-volatile memory card, a ROM or the like. Or the program code may be downloaded through a network.

Also, by executing the program code read out by the computer, not only the functions of the aforedescribed embodiments are realized, but of course, there is also covered a case where on the basis of the instructions of the program code, an operating system (OS) or the like working on the computer effects part or the whole of an actual treatment, and the functions of the aforedescribed embodiments are realized by the treatment.

Further, of course, there is also covered a case where the program code read out from the storage medium is written into a memory provided in a function enlarging card inserted in the computer or a function enlarging unit connected to the computer, whereafter on the basis of the instructions of the program code, a CPU or the like provided in the function enlarging card or the function enlarging unit effects part or the whole of an actual treatment, and the functions of the aforedescribed embodiments are realized by the treatment.

According to the present embodiment, when sheets of different thicknesses are mixedly present in a sheet bundle, the occurrence of faulty aftertreatment attributable to the thickness of the sheet bundle can be obviated.

This application claims priority from Japanese Patent Application No. 2004-081175 filed Mar. 19, 2004, which is hereby incorporated by reference herein.

What is claimed is:

1. An aftertreatment apparatus comprising:

a common conveying path for conveying sheets having images formed thereon by an image forming unit and a sheet to be inserted into the sheets in an order in which the sheets have been carried in:

an aftertreatment unit for forming a sheet bundle of the sheets conveyed through said common conveying path, and performing a set aftertreatment on the sheet bundle;

a sheet thickness detecting sensor for detecting a thickness of each sheet conveyed on said common conveying path; and a controller for accumulating the thicknesses of the sheets detected by said sheet thickness detecting sensor to calculate a thickness of the sheet bundle, and controlling said aftertreatment unit so as to change the set aftertreatment to another aftertreatment when the calculated thickness of the sheet bundle reaches a predetermined value, wherein said aftertreatment unit has a containing portion into which the sheets conveyed through said common conveying path are carried in an order of conveyance and are contained in a bundle shape, a stapler for stapling a central portion of the sheet bundle contained in said containing portion, and a folding member for folding the sheet bundle at a central portion of the sheet bundle, the set aftertreatment is a treatment of stapling the central portion of the sheet bundle contained in said containing portion by said stapler, and folding the stapled sheet bundle at the central portion of the sheet bundle by said folding member, and the another aftertreatment is a treatment of folding the sheet bundle contained in said containing portion at the central portion of the sheet bundle by said folding member without stapling the central portion of the sheet bundle contained in said containing portion by said stapler.

* * * * *

UNITED STATES PATENT AND TRADEMARK OFFICE

CERTIFICATE OF CORRECTION

PATENT NO. : 7,281,707 B2
APPLICATION NO. : 11/078452
DATED : October 16, 2007
INVENTOR(S) : Tsuyoshi Moriyama et al.

It is certified that error appears in the above-identified patent and that said Letters Patent is hereby corrected as shown below:

ON THE TITLE PAGE:
At Item (56), Foreign Patent Documents, “62186279 A” should read --62-186279 A--.

COLUMN 1:
Line 19, “inserted” should read --inserted sheet--.
Line 56, “sheets” should be deleted.

COLUMN 2:
Line 12, “staple-treatment” should read --staple-treated--.
Line 36, “bundle has exceeded the limit thickness” should be deleted.

COLUMN 3:
Line 54, “the relation between the output signal of” should be deleted.

COLUMN 4:
Line 27, “body” should read --body 10,--.
Line 38, “a” should read --an--.
Line 57, “the,” should read --the--.

COLUMN 5:
Line 65, “two-side” should read --two-sided--.

COLUMN 6:
Line 1, “there after” should read --thereafter--.
Line 2, “two-side” should read --two-sided--.
Line 3, “two-side” should read --two-sided--.

COLUMN 10:
Line 40, “umber” should read --number--.

COLUMN 12:
Line 42, “form” should read --from--.
Line 46, “for” should be deleted.

COLUMN 13:
Line 11, “form” should read --from--.
Line 34, “two-side” should read --two-sided--.
Line 39, “two-side” should read --two-sided--.

UNITED STATES PATENT AND TRADEMARK OFFICE

CERTIFICATE OF CORRECTION

PATENT NO. : 7,281,707 B2
APPLICATION NO. : 11/078452
DATED : October 16, 2007
INVENTOR(S) : Tsuyoshi Moriyama et al.

It is certified that error appears in the above-identified patent and that said Letters Patent is hereby corrected as shown below:

COLUMN 14:
Line 31, "form" should read --from--.
Line 35, "for" should be deleted.

COLUMN 15:
Line 29, "(step, S306)," should read --(step S306),--.
Line 34, "determined" should read --determines--.
Line 45, "for" should be deleted.

COLUMN 16:
Line 67, "embodiment" should read --embodiments--.

Signed and Sealed this

Twenty-fourth Day of June, 2008

JON W. DUDAS
*Director of the United States Patent and Trademark Office*